US010989021B1

(12) United States Patent
Stephenson

(10) Patent No.: US 10,989,021 B1
(45) Date of Patent: Apr. 27, 2021

(54) NOISE, VIBRATION AND EROSION REDUCTION IN VALVES

(71) Applicant: Halliburton Energy Services, Inc., Houston, TX (US)

(72) Inventor: Stanley Vernon Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/704,737

(22) Filed: Dec. 5, 2019

(51) Int. Cl.
*E21B 40/00* (2006.01)
*E21B 43/267* (2006.01)

(52) U.S. Cl.
CPC ..... *E21B 40/00* (2013.01); *E21B 43/267* (2013.01)

(58) Field of Classification Search
CPC ..... E21B 43/267; E21B 40/00
See application file for complete search history.

(56) References Cited

U.S. PATENT DOCUMENTS

| | | | | |
|---|---|---|---|---|
| 9,291,038 | B2 * | 3/2016 | Dotson | E21B 43/114 |
| 9,695,795 | B2 | 7/2017 | Martin et al. | |
| 9,945,210 | B2 | 4/2018 | Theodossiou | |
| 10,125,594 | B2 * | 11/2018 | Lewis | E21B 21/062 |

* cited by examiner

*Primary Examiner* — Matthew R Buck
(74) *Attorney, Agent, or Firm* — Conley Rose, P.C.; Rodney B. Carroll

(57) ABSTRACT

A pressure equalizing system comprising a high pressure pump, a low pressure pump, a pressure adjusting device, a fluid interface separator, and a chamber; wherein the system is transitionable between loading and discharging configurations via a pressure equalizing configuration; wherein the fluid interface separator is downstream of the high pressure and low pressure pumps, and upstream of the pressure adjusting device and chamber; wherein the fluid interface separator is configured to transition the system between loading and discharging configurations; wherein, when the system is in pressure equalizing configuration and transitioning from discharging to loading configuration, the pressure adjusting device decreases pressure of chamber from first pressure to within ±100 psig of second pressure; and wherein, when the system is in pressure equalizing configuration and transitioning from loading to discharging configuration, the pressure adjusting device increases pressure of chamber from second pressure to within ±100 psig of first pressure.

20 Claims, 2 Drawing Sheets

NOISE, VIBRATION AND EROSION REDUCTION IN VALVES

BACKGROUND

This disclosure relates to pressure equalizing systems and methods of using same. More specifically, it relates to pressure equalizing systems that can reduce noise, vibration, and erosion in pressure exchange interfaces, such as valves; and methods of using same.

Many industrial processes employ relatively high pressure fluids (e.g., fracturing fluids, acidizing fluids, etc.), where such high pressure fluids are provided at the desired pressure via high pressure pumps. However, some high pressure fluids may contain a variety of materials that can be undesirable in the high pressure pumps, such as abrasive materials and/or corrosive materials. Generally, high pressure pumps are expensive, and abrasive and/or corrosive materials can substantially decrease the life of a high pressure pump or its components.

Conventionally, energy recovery or exchange devices can be used to transfer pressure energy from "clean" fluids (e.g., fluids lacking abrasive materials and/or corrosive materials) pumped at high pressure via high pressure pumps to "dirty" fluids or "unclean" fluids (e.g., fluids containing abrasive materials and/or corrosive materials), in order to avoid pumping the unclean fluids via the high pressure pumps. However, conventional energy recovery devices are subject to high noise levels, high vibrations, and high erosion owing to the system employing the energy recovery devices being cycled between high and low pressures. While some conventional systems employ erosion resistant materials for making conventional energy recovery devices, such systems still display high noise levels, and high vibrations.

Conventional energy recovery devices can employ valves that open and close with high differential pressures, wherein such high differential pressures cause high levels of noise, vibrations, and erosion. Thus, an ongoing need exists for systems that can mitigate the high levels of noise, vibrations, and erosion in energy recovery devices, and methods of using same.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
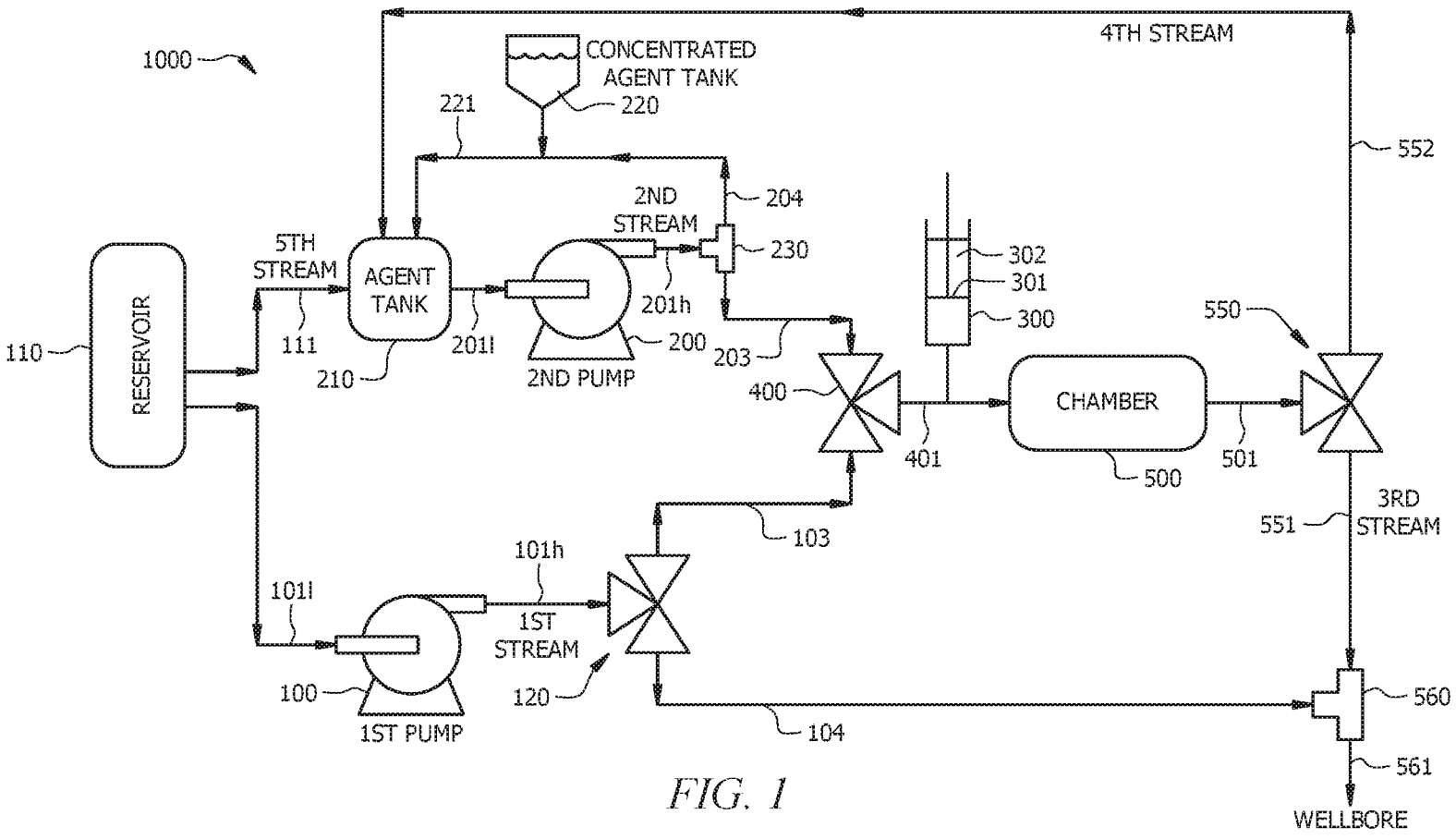
FIG. 1 displays a schematic of a pressure equalizing system.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques below, including the exemplary designs and implementations illustrated and described herein, but may be modified within the scope of the appended claims along with their full scope of equivalents.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to be limited to the embodiments illustrated and described herein. It is to be fully recognized that the different teachings of the embodiments discussed herein may be employed separately or in any suitable combination to produce desired results.

Disclosed herein is a pressure equalizing system that mitigates noise, vibrations, and erosion in energy recovery devices; and methods of using same. In an embodiment, a pressure equalizing system as disclosed herein can comprise a pressure adjusting device that can pressure balance the pressure equalizing system or components thereof (e.g., interfaces, valves, etc.), for example prior to transferring pressure energy from a relatively high pressure fluid to a relatively low pressure fluid. In some embodiments, a pressure equalizing system as disclosed herein can comprise a pressure adjusting device comprising a plunger extending into a chamber (e.g., working chamber; channel), and/or a cylinder (e.g., hydraulic cylinder) and plunger attached to the working chamber and/or a fluid conduit leading to and/or from the chamber; as will be described in more detail later herein. The plunger may retract to lower the chamber pressure when the pressure on the other side of a valve (for example) is relatively low, in order to pressure balance the valve, such that there would be little to no pressure differential across the valve before it is actuated. Further, the plunger may extend to increase the chamber pressure when the pressure on the other side of a valve (for example) is relatively high, in order to pressure balance the valve, such that there would be little to no pressure differential across the valve before it is actuated. Pressure balancing the pressure equalizing system or components thereof (e.g., interfaces, valves, etc.) by plunger (e.g., cylinder plunger) extension or retraction can advantageously reduce noise, vibration, and erosion in the pressure equalizing system.

Figure 2:
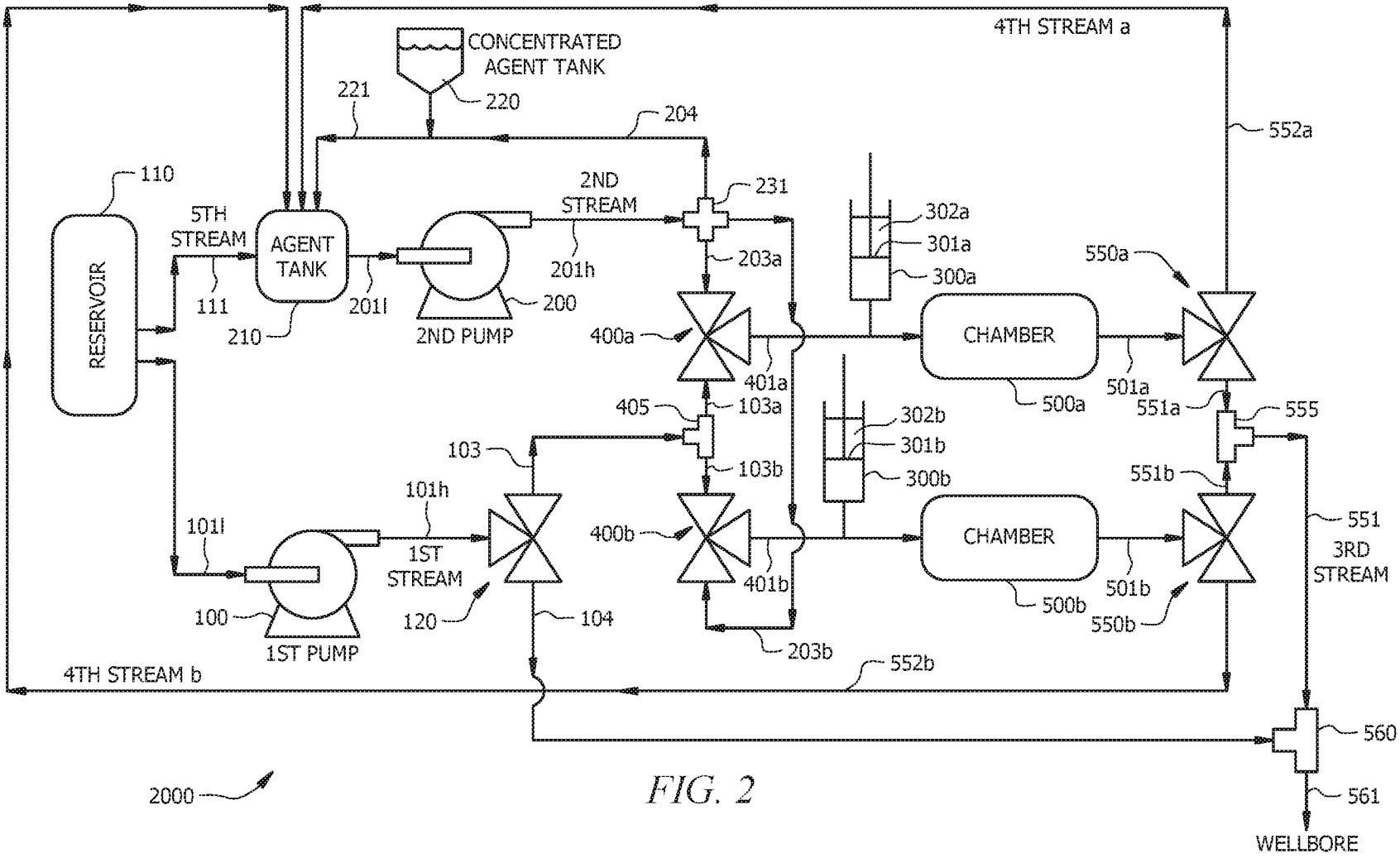
FIG. 2 displays a schematic of another pressure equalizing system.

In some embodiments, for example as depicted in FIGS. 1 and 2, a pressure equalizing system 1000, 2000 as disclosed herein can comprise a first pump 100 (e.g., a high pressure pump; a relatively high pressure pump); a second pump 200 (e.g., low pressure pump; a relatively low pressure pump); a pressure adjusting device 300, 300*a*, 300*b*; a fluid interface separator (e.g., first fluid interface separator) 400, 400*a*, 400*b*; and a chamber 500, 500*a*, 500*b*; wherein the pressure equalizing system is transitionable between a loading configuration and a discharging configuration via a pressure equalizing configuration. FIGS. 1 and 2 display schematics of the pressure equalizing systems 1000 and 2000, respectively.

In an embodiment, the first pump 100 is a high pressure pump or a relatively high pressure pump, wherein the first pump 100 is configured to output a first stream 101*h* at a first pressure. The first pump 100 receives the first stream 101*l* at a pressure lower than the first pressure, and outputs the first stream 101*h* at the first pressure. For example, the first pump 100 can receive the first stream 101*l* at a pressure of from about ambient pressure (e.g., atmospheric pressure) to about 100 psig, alternatively from about ambient pressure to about 75 psig, or alternatively from about ambient pressure to about 50 psig. The first pump 100 can be any suitable high pressure pump, such as a centrifugal pump, a multi-stage centrifugal pump, a positive displacement pump, etc.

In some embodiments, the first pressure (e.g., the pressure of the first stream 101*h* output by the first pump 100) can be equal to or greater than about 1,000 psig, alternatively equal to or greater than about 2,500 psig, alternatively equal to or greater than about 5,000 psig, alternatively equal to or greater than about 10,000 psig, alternatively equal to or greater than about 15,000 psig, alternatively equal to or greater than about 25,000 psig, alternatively equal to or greater than about 50,000 psig, alternatively equal to or greater than about 75,000 psig, alternatively equal to or greater than about 100,000 psig, alternatively from about 1,000 psig to about 50,000 psig, alternatively from about 2,500 psig to about 25,000 psig, or alternatively from about 5,000 psig to about 15,000 psig.

In an embodiment, the first stream 101*l*, 101*h* comprises a first fluid, wherein the first fluid is substantially free of an agent (e.g., proppant). The first fluid is a clean fluid, wherein the clean fluid is substantially free of an agent that is undesirable in the first pump 100, as the agent may damage or reduce the life time of the first pump 100 or components thereof. For purposes of the disclosure herein, the term "clean fluid" refers to a fluid (e.g., first fluid) that does not contain a significant amount of the agent; for example, the clean fluid comprises the agent in an amount of less than about 10 wt. %, alternatively less than about 9 wt. %, alternatively less than about 8 wt. %, alternatively less than about 7 wt. %, alternatively less than about 6 wt. %, alternatively less than about 5 wt. %, alternatively less than about 4 wt. %, alternatively less than about 3 wt. %, alternatively less than about 2 wt. %, alternatively less than about 1 wt. %, alternatively less than about 0.5 wt. %, alternatively less than about 0.1 wt. %, alternatively less than about 0.01 wt. %, or alternatively less than about 0.001 wt. %, based on the total weight of the clean fluid. In an embodiment, the clean fluid is substantially free of the agent. In an embodiment, the clean fluid does not contain a significant amount of solid materials (e.g., proppant, sand, gravel) suspended therein.

In some embodiments, the clean fluid is an aqueous fluid. In other embodiments, the clean fluid is an oil-based fluid. In yet other embodiments, the clean fluid includes an emulsion or an invert emulsion.

Aqueous fluids that may be used as clean fluids in the present disclosure may include water or a brine. In an embodiment, the clean fluid includes an aqueous brine. In such embodiment, the aqueous brine generally includes water and an inorganic monovalent salt, an inorganic multivalent salt, or both. The aqueous brine may be naturally occurring or artificially-created. Water present in the brine may be from any suitable source, examples of which include, but are not limited to, sea water, tap water, freshwater, water that is potable or non-potable, untreated water, partially treated water, treated water, produced water, city water, well-water, surface water, liquids including water-miscible organic compounds, and combinations thereof. The salt or salts in the water may be present in an amount ranging from greater than about 0% by weight to a saturated salt solution, alternatively from about 1 wt. % to about 30 wt. %, or alternatively from about 5 wt. % to about 10 wt. %, based on the weight of the salt solution. In an embodiment, the salt or salts in the water may be present within the clean fluid in an amount sufficient to yield a saturated brine. In some embodiments, the brines may include any suitable additives, such as viscosifying agents.

Nonlimiting examples of aqueous brines suitable for use in the present disclosure include chloride-based, bromide-based, phosphate-based or formate-based brines containing monovalent and/or polyvalent cations, salts of alkali and alkaline earth metals, or combinations thereof. Additional examples of suitable brines include, but are not limited to brines including NaCl, KCl, NaBr, $CaCl_2$, $CaBr_2$, $ZnBr_2$, ammonium chloride ($NH_4Cl$), potassium phosphate, sodium formate, potassium formate, cesium formate, ethyl formate, methyl formate, methyl chloroformate, triethyl orthoformate, trimethyl orthoformate, or combinations thereof. In an embodiment, the clean fluid includes a brine.

In an embodiment, the clean fluid includes an oil-based fluid, such as for example an oleaginous fluid. Examples of oleaginous fluids suitable for use as a clean fluid in the present disclosure include, but are not limited to, petroleum oils, natural oils, synthetically-derived oils, oxygenated fluids, or combinations thereof. In an embodiment, the oleaginous fluid includes diesel oil, kerosene oil, natural gas condensates, mineral oil, synthetic oils, aliphatic hydrocarbons, polyolefins (e.g., alpha olefins, linear alpha olefins and/or internal olefins), paraffins, silicone fluids, polydiorganosiloxanes, oxygenated solvents, esters, diesters of carbonic acid, alcohols, alcohol esters, ethers, ethylene glycol, ethylene glycol monoalkyl ether, ethylene glycol dialkyl ether, or combinations thereof, wherein the alkyl groups are methyl, ethyl, propyl, butyl, and the like.

In an embodiment, the clean fluid includes an emulsion. In such embodiment, the emulsion is an oil-in-water emulsion including a non-oleaginous (e.g., an aqueous fluid of the type previously described herein) continuous phase and an oleaginous (e.g., an oil-based fluid of the type previously described herein) discontinuous phase.

In another embodiment, the clean fluid includes an invert emulsion. In such embodiment, the invert emulsion is a water-in-oil emulsion including an oleaginous (e.g., an oil-based fluid of the type previously described herein) continuous phase and a non-oleaginous (e.g., an aqueous fluid of the type previously described herein) discontinuous phase.

In an embodiment, the agent can be any substance or material that is undesirable in relatively high pressure pumps, such as the first pump 100, wherein the agent is however desirable in a relatively high pressure fluid (e.g., a fluid characterized by about the first pressure, such as streams 101*h*, 551, 561) for use in a particular application. Nonlimiting examples of agents include a proppant, sand, rocks, sticks, fibers, gravel, sintered bauxite, a ceramic material, a diverting material, an abrasive material, a fluid loss material, an acid, HCl, HF, a scale inhibitor, a friction reducer, an electronic device (e.g., a small electronic device, a relatively small electronic device), a sensor, a sensor node, a wireless sensor node such as a mote, and the like, or combinations thereof.

Nonlimiting examples of proppants suitable for use in this disclosure include silica (sand), graded sand, Ottawa sands, Brady sands, Colorado sands; resin-coated sands; gravels; synthetic organic particles, nylon pellets, high density plastics, teflons, polytetrafluoroethylenes, rubbers, resins; ceramics, aluminosilicates; glass; sintered bauxite; quartz; aluminum pellets; ground or crushed shells of nuts, walnuts, pecans, almonds, ivory nuts, brazil nuts, and the like; ground or crushed seed shells (including fruit pits) of seeds of fruits, plums, peaches, cherries, apricots, and the like; ground or crushed seed shells of other plants (e.g., maize, corn cobs or corn kernels); crushed fruit pits or processed wood materials, materials derived from woods, oak, hickory, walnut, poplar, mahogany, and the like, including such woods that have been processed by grinding, chipping, or other form of particleization; resin coated particulate materials; or combinations thereof. In an embodiment, the proppant comprises sand.

The proppant may be of any suitable size and/or shape. In an embodiment, a proppant suitable for use in the present disclosure may have an average particle size in the range of from about 2 mesh to about 400 mesh, alternatively from about 8 mesh to about 100 mesh, or alternatively from about 10 mesh to about 70 mesh, U.S. Sieve Series. Nonlimiting examples of proppant shapes suitable for use in the present disclosure include cylindrical, discoidal, spherical, tabular, ellipsoidal, equant, irregular, cubic, acicular, and the like, or combinations thereof.

In an embodiment, the second pump 200 is a low pressure pump or a relatively low pressure pump, wherein the second pump 200 is configured to output a second stream 201*h* at a second pressure. For purposes of the disclosure herein, the first pump 100 is a relatively high pressure pump when compared to the second pump 200. Similarly, for purposes of the disclosure herein, the first pressure is a relatively high pressure when compared to the second pressure.

Further, for purposes of the disclosure herein, the second pump 200 is a relatively low pressure pump when compared to the first pump 100. Similarly, for purposes of the disclosure herein, the second pressure is a relatively low pressure when compared to the first pressure.

The second pump 200 receives the second stream 201*l* at a pressure lower than the second pressure, and outputs the second stream 201*h* at the second pressure. For example, the second pump 200 can receive the second stream 201*l* at a pressure of from about ambient pressure (e.g., atmospheric pressure) to about 100 psig, alternatively from about ambient pressure to about 75 psig, or alternatively from about ambient pressure to about 50 psig. The second pump 200 can be any suitable low pressure pump, such as a slurry pump, a mud pump, a positive displacement pump, a centrifugal pump, a centrifugal boost pump, etc.

In some embodiments, the second pressure (e.g., the pressure of the second stream 201*h* output by the second pump 200) can be equal to or greater than about 10 psig, alternatively equal to or greater than about 25 psig, alternatively equal to or greater than about 50 psig, alternatively equal to or greater than about 100 psig, alternatively from about 10 psig to about 500 psig, alternatively from about 50 psig to about 475 psig, or alternatively from about 100 psig to about 450 psig.

In an embodiment, the first pressure can be equal to or greater than about 200%, alternatively equal to or greater than about 300%, alternatively equal to or greater than about 400%, alternatively equal to or greater than about 500%, alternatively equal to or greater than about 600%, alternatively equal to or greater than about 700%, alternatively equal to or greater than about 800%, alternatively equal to or greater than about 900%, or alternatively equal to or greater than about 1,000% of the second pressure.

In an embodiment, the second stream 201*l*, 201*h* comprises a second fluid, wherein the second fluid comprises the agent (e.g., proppant). The second fluid is an unclean fluid, wherein the agent in the unclean fluid is desirable in a relatively high pressure fluid for a particular application (e.g., wellbore servicing application). For purposes of the disclosure herein, the terms "unclean fluid" or "dirty fluid" can be used interchangeably and refer to a fluid (e.g., second fluid) that contains a significant amount of the agent. The unclean fluid comprises an unclean base fluid and the agent. For example, the unclean fluid comprises the agent in an amount of equal to or greater than about 5 wt. %, alternatively equal to or greater than about 10 wt. %, alternatively equal to or greater than about 15 wt. %, alternatively equal to or greater than about 20 wt. %, or alternatively equal to or greater than about 25 wt. %, based on the total weight of the unclean fluid. In an embodiment, the unclean fluid contains a significant amount of solid materials (e.g., proppant, sand, gravel) suspended therein (e.g., suspended in the unclean base fluid).

In some embodiments, the second fluid can be a sand slurry (e.g., aqueous sand slurry); for example, a sand slurry having from about 0.1 lbs to about 27 lbs of sand per gallon of fluid, alternatively from about 1 lbs to about 27 lbs of sand per gallon of fluid, alternatively from about 4 lbs to about 27 lbs of sand per gallon of fluid, alternatively from about 7 lbs to about 27 lbs of sand per gallon of fluid, alternatively from about 10 lbs to about 27 lbs of sand per gallon of fluid, alternatively from about 20 lbs to about 27 lbs of sand per gallon of fluid, or alternatively from about 15 lbs to about 25 lbs of sand per gallon of fluid.

In some embodiments, the unclean base fluid is an aqueous fluid. For example, unclean fluid comprises an aqueous fluid and the agent. In other embodiments, the unclean base fluid is an oil-based fluid. For example, the unclean fluid comprises an oil-based fluid and the agent. In yet other embodiments, the unclean base fluid includes an emulsion or an invert emulsion. For example, the unclean fluid comprises an emulsion or an invert emulsion, and the agent.

The unclean base fluid has been described in detail herein as clean fluid. The unclean base fluids disclosed herein can be the same or different than the clean fluids disclosed herein. For example, the clean fluid and the unclean base fluid can both be seawater. As another example, the clean fluid can be seawater, and unclean base fluid can be a KCl brine. As yet another example, the clean fluid can be an oleaginous fluid, and the unclean base fluid can be an invert emulsion.

In embodiments where the unclean base fluid is the same as the clean fluid, for example as illustrated in FIGS. 1 and 2, the pressure equalizing systems 1000, 2000 can comprise a reservoir 110 comprising the clean fluid, and an agent tank 210 comprising the unclean fluid. The reservoir 110 provides for the first stream 101*l* comprising clean fluid that is introduced to the first pump 100 to increase its pressure and provide for the first stream 101*h* having the first pressure. The reservoir 110 can also provide for a fifth stream 111 comprising clean fluid that is introduced to the agent tank 210, thereby providing the unclean base fluid necessary for making the unclean fluid in the agent tank 210.

In embodiments where the unclean base fluid is different than the clean fluid, the pressure equalizing systems can comprise a first reservoir comprising the clean fluid, and a second reservoir comprising the unclean base fluid. The first reservoir can provide for the first stream 101*l* comprising clean fluid that is introduced to the first pump 100 to increase its pressure and provide for the first stream 101*h*. The second reservoir can provide for a fifth stream 111 comprising unclean base fluid that is introduced to the agent tank 210, thereby providing the unclean base fluid necessary for making the unclean fluid in the agent tank 210.

The pressure equalizing systems 1000, 2000 can comprise a concentrated agent tank 220 comprising the agent, wherein a concentration of the agent in the concentrated agent tank 220 is greater than a concentration of the agent in the agent tank 210 (e.g., a concentration of the agent in the unclean fluid). For example, the concentrated agent tank 220 can be a hopper (e.g., solid material storage and metering), wherein a solid agent (e.g., proppant, sand) can be stored in the hopper and conveyed to the agent tank 210 via stream 221 in an amount effective to provide for the desired concentration of the agent in the agent tank 210 (e.g., desired concentration of the agent in the unclean fluid); wherein a base fluid (e.g., an unclean base fluid) can also be introduced to the agent tank 210 and mixed with the solid agent for forming an unclean fluid slurry (e.g., second fluid). In embodiments where the concentrated agent tank 220 is employed for conveying solids to the agent tank 210, the agent tank 210 can comprise any suitable mixing device, such as a blender, a mixer, a mixing tank or tub, and the like, or combinations thereof. As another example, the concentrated agent tank 220 can be a concentrated acid solution storage container, wherein a concentrated acid (e.g., concentrated HCl, such as about 38% HCl) can be stored in the concentrated agent tank 220 and conveyed to the agent tank 210 via stream 221 in an amount effective to provide for the desired concentration of the agent in the agent tank 210 (e.g., desired concentration of the agent in the unclean fluid); wherein a base fluid (e.g., an unclean base fluid) can also be introduced to the agent tank 210 and mixed with the concentrated acid for forming the unclean fluid (e.g., second fluid).

The agent tank 210 can comprise any device suitable for mixing the agent and the unclean base fluid (e.g., clean fluid), for example a mixer, a blender, etc. In embodiments where the unclean fluid is a slurry, the agent (e.g., solid particles) can settle, and as such the slurry may need to be continually mixed and/or circulated in the agent tank 210. For example, and as illustrated in FIGS. 1 and 2, the second pump 200 can continually circulate an unclean fluid (e.g., slurry) through a tee 230, 231 providing for a stream 204 that can optionally contact the agent dispensed from the concentrated agent tank 220, thereby forming stream 221; wherein streams 204, 221 can be introduced to the agent tank 210.

In an embodiment, for example as illustrated in FIG. 1, the fluid interface separator 400 is located downstream of the first pump 100 and the second pump 200, and upstream of the pressure adjusting device 300 and the chamber 500. The fluid interface separator 400 controls the flow of fluids into the chamber 500, and does not allow for the first fluid and the second fluid to flow into the chamber 500 at the same time (i.e., concurrently).

The fluid interface separator 400 provides for the first fluid and the second fluid flowing sequentially (as opposed to concurrently) and alternatingly into the chamber 500. For example, the fluid interface separator 400 can allow for at least a portion 203 of the second stream 201*h* having the second pressure to flow via conduit 401 into the chamber 500. When it is desired to stop the flow of relatively low pressure unclean fluid (e.g., unclean fluid having the second pressure) into chamber 500, the fluid interface separator 400 can prevent the unclean fluid in stream 203 from entering conduit 401. When it is desired to commence the flow of relatively high pressure clean fluid (e.g., clean fluid having the first pressure) into chamber 500, the fluid interface separator 400 can allow for at least a portion 103 of the first stream 101*h* having the first pressure to flow via conduit 401 into the chamber 500. When it is desired to stop the flow of relatively high pressure clean fluid (e.g., clean fluid having the first pressure) into chamber 500, the fluid interface separator 400 can prevent the clean fluid in stream 103 from entering conduit 401. When it is desired again to commence the flow of relatively low pressure unclean fluid (e.g., unclean fluid having the second pressure) into chamber 500, the fluid interface separator 400 can allow for at least a portion 203 of the second stream 201*h* at the second pressure to flow via conduit 401 into the chamber 500.

The fluid interface separator 400 can be any suitable device that can separate a relatively high pressure fluid (e.g., first fluid) from a relatively low pressure fluid (e.g., second fluid), while providing for an alternating flow of the first fluid and the second fluid via conduit 401 into the chamber 500. The fluid interface separator 400 can be a valve, such as a first valve 400. For example, the first valve 400 can comprise a 3-way valve or two 2-way valves.

In an embodiment, the pressure equalizing system 1000 as disclosed herein may comprise a second fluid interface separator (e.g., second valve) 550 located downstream of the chamber 500.

The fluid interface separator 400 is configured to transition the pressure equalizing system between the loading configuration and the discharging configuration via the pressure equalizing configuration. When the pressure equalizing system is in the loading configuration, the fluid interface separator 400 allows for at least a portion 203 of the second stream 201*h* having the second pressure to flow via conduit 401 into the chamber 500; wherein the fluid (e.g., unclean fluid) flowing into the chamber 500 can displace a fluid (e.g., clean fluid) in chamber 500 via conduit 501 and second fluid interface separator 550 (wherein the second fluid interface separator 550 is actuated in an open position) into stream 552, as will be described in more detail later herein. When the pressure equalizing system is in the discharging configuration, the fluid interface separator 400 allows for at least a portion 103 of the first stream 101*h* having the first pressure to flow via conduit 401 into the chamber 500; wherein the fluid (e.g., clean fluid) flowing into the chamber 500 can displace a fluid (e.g., unclean fluid) in chamber 500 via conduit 501 and second fluid interface separator 550 (wherein the second fluid interface separator 550 is actuated in an open position) into stream 551, as will be described in more detail later herein. When the pressure equalizing system is in the pressure equalizing configuration, the fluid interface separator 400 stops (e.g., prevents) the flow of both the low pressure unclean fluid stream 203 and the high pressure clean fluid stream 103 into the conduit 401 and the chamber 500; wherein the second fluid interface separator 550 is actuated in a closed position, thereby stopping (e.g., preventing) the flow of unclean fluid or clean fluid from chamber 500 via conduit 501 into streams 551 or 552, respectively, as will be described in more detail later herein.

The low pressure unclean fluid stream 203 is provided by the second pump 200 via the tee 230. The high pressure clean fluid stream 103 (e.g., a first portion of the high pressure clean fluid) can be provided by the first pump 100 via a valve 120, wherein a second portion 104 of the high pressure clean fluid can be provided by the first pump 100 via the valve 120 for mixing with a high pressure unclean fluid, as will be discussed in more detail later herein. Valves 120, 400, and 550 can be high pressure valves.

In embodiments where the pressure equalizing system is in the loading configuration, the fluid interface separator 400 is configured to separate a high pressure loading side from a low pressure loading side in the pressure equalizing system; wherein the high pressure loading side is characterized by about the first pressure; and wherein the low pressure loading side is characterized by about the second pressure. The high pressure loading side comprises the first pump 100; as well as valve 120. The low pressure loading side comprises the second pump 200, the pressure adjusting device 300, and the chamber 500; as well as the tee 230, 231, agent tank 210, concentrated agent tank 220, and reservoir 110. When the pressure equalizing system is in the loading configuration, the fluid interface separator 400 prevents the flow of the high pressure clean fluid stream 103 into the conduit 401 and the chamber 500, while allowing the flow of the low pressure unclean fluid stream 203 into the conduit 401 and the chamber 500. When the pressure equalizing system is in the loading configuration, the second fluid interface separator 550 separates the relatively high pressure stream 551 from the relatively low pressure stream 552; i.e., the second fluid interface separator 550 allows for the flow of relatively low pressure clean fluid displaced from chamber 500 via conduit 501 into stream 552, while preventing the flow of fluid from chamber 500 into the relatively high pressure stream 551.

In embodiments where the pressure equalizing system is in the discharging configuration, the fluid interface separator 400 is configured to separate a high pressure discharging side from a low pressure discharging side in the pressure equalizing system; wherein the high pressure discharging side is characterized by about the first pressure; and wherein the low pressure discharging side is characterized by about the second pressure. The high pressure discharging side comprises the first pump 100, the pressure adjusting device 300, and the chamber 500; as well as valve 120. The low pressure discharging side comprises the second pump 200; as well as the tee 230, 231, agent tank 210, concentrated agent tank 220, and reservoir 110. When the pressure equalizing system is in the discharging configuration, the fluid interface separator 400 prevents the flow of the low pressure unclean fluid stream 203 into the conduit 401 and the chamber 500, while allowing the flow of the high pressure clean fluid stream 103 into the conduit 401 and the chamber 500. When the pressure equalizing system is in the discharging configuration, the second fluid interface separator 550 separates the relatively high pressure stream 551 from the relatively low pressure stream 552; i.e., the second fluid interface separator 550 allows for the flow of relatively high pressure unclean fluid displaced from chamber 500 via conduit 501 into stream 551, while preventing the flow of fluid from chamber 500 into the relatively low pressure stream 552.

In embodiments where the pressure equalizing system is transitioning between the discharging configuration and the loading configuration, the pressure equalizing configuration comprises the fluid interface separator 400 configured to separate from each other each of (i) the first pump 100 and valve 120, (ii) the second pump 200, tee 230, 231, agent tank 210, concentrated agent tank 220, and reservoir 110, and (iii) the pressure adjusting device 300 and chamber 500. When the pressure equalizing system is in the pressure equalizing configuration, the fluid interface separator 400 prevents the flow of both the high pressure clean fluid stream 103 and the low pressure unclean fluid stream 203 into the conduit 401 and the chamber 500; thereby isolating the chamber 500 from both the first pump 100 and the second pump 200.

In embodiments where the pressure equalizing system is transitioning between the discharging configuration and the loading configuration, the pressure equalizing configuration comprises the second fluid interface separator 550 configured to separate from each other each of (1) the pressure adjusting device 300 and chamber 500; (2) third stream 551, tee 560, stream 561, the first pump 100 and valve 120; and (3) fourth stream 552, the second pump 200, tee 230, 231, agent tank 210, concentrated agent tank 220, and reservoir 110. In some embodiments where the pressure equalizing system is transitioning between the discharging configuration and the loading configuration, the pressure equalizing configuration comprises the second fluid interface separator 550 configured to separate from each other each of (1) the pressure adjusting device 300 and chamber 500; (2) third stream 551, tee 560, stream 561; and (3) fourth stream 552. The pressure equalizing configuration can advantageously provide for pressure equalization across the second fluid interface separator 550, thereby minimizing vibration, noise, erosion, etc. when the second fluid interface separator 550 is cycled (e.g., actuated in an open and/or closed position between various pressure equalizing system configurations).

In embodiments where the pressure equalizing system is in the pressure equalizing configuration and transitioning from the discharging configuration to the loading configuration, the pressure adjusting device 300 is configured to equalize the pressure between the chamber 500 and the second pump 200. When the pressure equalizing system is in the pressure equalizing configuration and transitioning from the discharging configuration to the loading configuration, the chamber 500 is characterized by a pressure substantially the same as the first pressure, while the second pump outputs the second stream **201*h* at the second pressure. The pressure adjusting device 300 decreases the pressure of the chamber 500 to a pressure that is about the same as the second pressure, e.g., the pressure adjusting device 300 decreases the pressure of the chamber 500** from about the first pressure to a pressure within about ±100 psig, alternatively within about ±75 psig, alternatively within about ±50 psig, alternatively within about ±25 psig, alternatively within about ±10 psig, alternatively within about ±5 psig, or alternatively within about ±1 psig of the second pressure.

The chamber 500 can be any suitable high pressure vessel that can withstand pressures of equal to or greater than about the first pressure. The high pressure vessel can comprise a shell that is designed to withstand pressures of equal to or greater than about the first pressure. In some embodiments, the chamber 500 can be a suitable length of a relatively high pressure pipe.

In embodiments where the pressure equalizing system is in the pressure equalizing configuration and transitioning from the loading configuration to the discharging configuration, the pressure adjusting device 300 is configured to equalize the pressure between the chamber 500 and the first pump 100. When the pressure equalizing system is in the pressure equalizing configuration and transitioning from the loading configuration to the discharging configuration, the chamber 500 is characterized by a pressure substantially the same as the second pressure, while the first pump outputs the first stream **201*h* at the first pressure. The pressure adjusting device 300 increases the pressure of the chamber 500 to a pressure that is about the same as the first pressure, e.g., the pressure adjusting device 300 increases the pressure of the chamber 500** from about the second pressure to a pressure within about ±100 psig, alternatively within about ±75 psig, alternatively within about ±50 psig, alternatively within about ±25 psig, alternatively within about ±10 psig, alternatively within about ±5 psig, or alternatively within about ±1 psig of the first pressure.

In an embodiment, the pressure adjusting device 300 comprises a hydraulic cylinder, a piston, a plunger, a bellows, a bladder, and the like, or combinations thereof.

The pressure adjusting device 300 is fluidly connected to the chamber 500, and can either apply pressure to chamber 500, thereby increasing the pressure in the chamber 500; or detract pressure from the chamber 500, thereby decreasing the pressure in the chamber 500.

In some embodiments, the pressure adjusting device 300 can be located upstream of the chamber 500 and downstream of the fluid interface separator 400; for example, the pressure adjusting device 300 can be fluidly coupled to the conduit 401 (as illustrated in FIG. 1).

In other embodiments, the pressure adjusting device 300 can be located downstream of the chamber 500 and upstream of a second valve 550; for example, the pressure adjusting device 300 can be fluidly coupled to conduit 501.

In yet other embodiments, the pressure adjusting device 300 can penetrate through the shell of the chamber 500, and thus can be fluidly connected to the chamber 500.

In still yet other embodiments, each chamber 500 may have a pressure adjusting device 300 (*i*) located upstream of the chamber 500; (ii) located downstream of the chamber 500; (iii) penetrating through the shell of the chamber 500; or (iv) any combinations of (i)-(iii).

In an embodiment, the pressure adjusting device 300 may comprises a piston 301 (which may be a piston in a hydraulic cylinder 300, for example) that can be driven by hydraulic fluid being pumped into or out of cylinder chamber 302 in a direction effective for adjusting the pressure of the chamber 500. For example, pumping hydraulic fluid into cylinder chamber 302 may extend the piston towards the fluid (e.g., unclean fluid) that it intends to compress (e.g., increase the pressure of), thereby causing the piston 301 to compress the fluid (i.e., increase the pressure of the fluid). As another example, releasing hydraulic fluid out of cylinder chamber 302 may retract the piston away from the fluid (e.g., clean fluid) that it intends to decompress (e.g., decrease the pressure of), thereby causing the piston 301 to decompress the fluid (i.e., decrease the pressure of the fluid).

The second valve 550 can comprise any suitable 2-way valve, 3-way valve, two 2-way valves, and the like, or combinations thereof. The second valve 550 can be a high pressure valve.

In embodiments where the pressure equalizing system is in the pressure equalizing configuration, the second valve 550 is actuated in a closed position, thereby fluidly isolating the chamber 500 from pressure equalizing system components other than the pressure adjusting device 300 (e.g., first pump 100, valve 120, second pump 200, tee 230, 231, agent tank 210, concentrated agent tank 220, and reservoir 110) and allowing for the pressure adjusting device 300 to adjust the pressure of the chamber 500.

In embodiments where the pressure equalizing system is in the loading configuration, the first valve 400 is configured to allow for the second stream having the second pressure 201*h* to enter and fill the chamber 500 with the second fluid (e.g., unclean fluid having the second pressure). In such embodiments, the second valve 550 may be actuated in a closed position, thereby allowing for the second fluid to enter and fill the chamber 500, as opposed to flowing straight through chamber 500 and into streams 501, 551 at the second pressure.

In embodiments where the pressure equalizing system is in the discharging configuration, the first valve 400 is configured to allow for a first portion 103 of the high pressure first stream to enter chamber 500 and displace the second fluid, thereby providing for a third stream 501, 551 comprising the second fluid exiting the chamber 500 at about the first pressure. In such embodiments, the second valve 550 is actuated in an open position, thereby allowing for the second fluid (e.g., unclean fluid) having the first pressure to flow into stream 551.

In some embodiments, the third stream 551 may contact a second portion 104 of the high pressure first stream (provided by the first pump 100 via the valve 120) to form a pressurized loaded stream 561 comprising a third fluid comprising the agent (e.g., high pressure sand laden fracturing fluid), wherein a concentration of agent in the third fluid is lower than a concentration of agent in the second fluid. As will be appreciated by one of skill in the art, and with the help of this disclosure, and without wishing to be limited by theory, when the second fluid comprising the agent (in third stream 551) is diluted with clean fluid lacking the agent (second portion 104 of the high pressure first stream) to form a third fluid comprising the agent (pressurized loaded stream 561), the concentration of the agent in the third fluid will be lower than the concentration of the agent in the second fluid. In such embodiments, and as will be described in more detail later herein, the pressurized loaded stream 561 can be a wellbore servicing fluid (WSF), wherein the WSF comprises a fracturing fluid, a gravel packing fluid, or an acidizing fluid.

The third stream 551 can be combined with the second portion 104 of the high pressure first stream via a tee 560 to form the pressurized loaded stream 561.

In other embodiments, the third stream 551 may be delivered into the pressurized loaded stream 561 without any further dilution, wherein the concentration of the agent in the third stream 551 is substantially the same as (e.g., equal to) the concentration of the agent in the pressurized loaded stream 561. In such embodiments, the pressurized loaded stream 561 is the third stream 551. In such embodiments, and as will be described in more detail later herein, the third stream 551 and/or the pressurized loaded stream 561 can be a wellbore servicing fluid (WSF), wherein the WSF comprises a fracturing fluid, a gravel packing fluid, or an acidizing fluid.

In embodiments where the chamber 500 comprises the first fluid (e.g., clean fluid); during the loading configuration, the second fluid displaces the first fluid in the chamber 500, thereby providing for a fourth stream 552 comprising the first fluid exiting the chamber 500 at about the second pressure. In such embodiments, the second valve 550 is actuated in an open position, thereby allowing for the first fluid (e.g., clean fluid) having the second pressure to flow into stream 552. The second valve 550 can selectively allow for (i) the flow of unclean fluid from chamber 500 into stream 551 during the discharging configuration; (ii) the flow of clean fluid from chamber 500 into stream 552 during the loading configuration; or (iii) no fluid flow from the chamber 500 during the pressure equalizing configuration.

The fourth stream 552 comprising clean fluid can be introduced to the agent tank 210 comprising the second fluid; wherein the clean fluid from stream 552 can be mixed with the agent in the agent tank 210 for forming an unclean fluid slurry (e.g., second fluid).

In an embodiment, the pressure equalizing system 2000, for example as illustrated in FIG. 2, can comprise at least two chambers 500*a*, 500*b* configured to operate in parallel; wherein at least one chamber 500*a*, 500*b* is in the discharging configuration at any given time, thereby providing for a continuous operation of the pressure equalizing system 2000. The pressure equalizing system 2000 can comprise a pressure adjusting device 300*a*, 300*b* for each chamber 500*a*, 500*b*, respectively; wherein each pressure adjusting device 300*a*, 300*b* is configured to adjust the pressure in its corresponding chamber 500*a*, 500*b*, respectively, during the pressure equalizing configuration for that particular chamber.

Each pressure adjusting device 300*a*, 300*b* can comprise a piston 301*a*, 301*b*, respectively, connected to a cylinder chamber 302*a*, 302*b*, respectively, wherein hydraulic fluid pumped into or released from cylinder chamber 302*a*, 302*b* may move the piston 301*a*, 301*b*, respectively, in a desired direction, i.e., a direction effective for adjusting the pressure of the chamber 500*a*, 500*b*, respectively, as previously described herein for chamber 500 and pressure adjusting device 300.

In an embodiment, the pressure equalizing system 2000, for example as illustrated in FIG. 2, can comprise at least two fluid interface separators 400*a*, 400*b*; wherein each fluid interface separator 400*a*, 400*b* is located (1) upstream of the corresponding chamber 500*a*, 500*b*, respectively, and corresponding pressure adjusting device 300*a*, 300*b*, respectively, and (2) downstream of the first pump 100 (e.g., high pressure pump) and the second pump 200 (e.g., low pressure pump).

The fluid interface separators 400*a*, 400*b* can provide for the first fluid and the second fluid flowing sequentially (as opposed to concurrently) and alternatingly into each of the chambers 500*a*, 500*b*.

The fluid interface separator 400*a* can receive the second fluid at the second pressure from the second pump 200 via tee 231 and stream 203*a*. Further, the fluid interface separator 400*a* can receive the first fluid at the first pressure from the first pump 100 via valve 120, stream 103, tee 405 and stream 103*a*. The fluid interface separator 400*a* can allow for at least a portion 203*a* of the second stream 201*h* having the second pressure to flow via conduit 401*a* into the chamber 500*a*. When it is desired to stop the flow of relatively low pressure unclean fluid (e.g., unclean fluid having the second pressure) into chamber 500*a*, the fluid interface separator 400*a* can prevent the unclean fluid in stream 203*a* from entering conduit 401*a*. When it is desired to commence the flow of relatively high pressure clean fluid (e.g., clean fluid having the first pressure) into chamber 500*a*, the fluid interface separator 400*a* can allow for at least a portion 103*a* of the first stream 101*h* having the first pressure to flow via conduit 401*a* into the chamber 500*a*. When it is desired to stop the flow of relatively high pressure clean fluid (e.g., clean fluid having the first pressure) into chamber 500*a*, the fluid interface separator 400*a* can prevent the clean fluid in stream 103*a* from entering conduit 401*a*. When it is desired again to commence the flow of relatively low pressure unclean fluid (e.g., unclean fluid having the second pressure) into chamber 500*a*, the fluid interface separator 400*a* can allow for at least a portion 203*a* of the second stream 201*h* at the second pressure to flow via conduit 401*a* into the chamber 500*a*.

The fluid interface separator 400*b* can receive the second fluid at the second pressure from the second pump 200 via tee 231 and stream 203*b*. Further, the fluid interface separator 400*b* can receive the first fluid at the first pressure from the first pump 100 via valve 120, stream 103, tee 405 and stream 103*b*. The fluid interface separator 400*b* can allow for at least a portion 203*b* of the second stream 201*h* having the second pressure to flow via conduit 401*b* into the chamber 500*b*. When it is desired to stop the flow of relatively low pressure unclean fluid (e.g., unclean fluid having the second pressure) into chamber 500*b*, the fluid interface separator 400*b* can prevent the unclean fluid in stream 203*b* from entering conduit 401*b*. When it is desired to commence the flow of relatively high pressure clean fluid (e.g., clean fluid having the first pressure) into chamber 500*b*, the fluid interface separator 400*b* can allow for at least a portion 103*b* of the first stream 101*h* having the first pressure to flow via conduit 401*b* into the chamber 500*b*. When it is desired to stop the flow of relatively high pressure clean fluid (e.g., clean fluid having the first pressure) into chamber 500*b*, the fluid interface separator 400*b* can prevent the clean fluid in stream 103*b* from entering conduit 401*b*. When it is desired again to commence the flow of relatively low pressure unclean fluid (e.g., unclean fluid having the second pressure) into chamber 500*b*, the fluid interface separator 400*b* can allow for at least a portion 203*b* of the second stream 201*h* at the second pressure to flow via conduit 401*b* into the chamber 500*b*.

In some embodiments, each pressure adjusting device 300*a*, 300*b* can be located upstream of its corresponding chamber 500*a*, 500*b*, respectively, and downstream of the corresponding fluid interface separator 400*a*, 400*b*, respectively; for example, each pressure adjusting device 300*a*, 300*b* can be fluidly coupled to the corresponding conduit 401*a*, 401*b*, respectively (as illustrated in FIG. 2).

In other embodiments, each pressure adjusting device 300*a*, 300*b* can be located downstream of its corresponding chamber 500*a*, 500*b*, respectively, and upstream of a corresponding second valve 550*a*, 550*b*, respectively; for example, each pressure adjusting device 300*a*, 300*b* can be fluidly coupled to corresponding conduit 501*a*, 501*b*, respectively.

In yet other embodiments, each pressure adjusting device 300*a*, 300*b* can penetrate through the shell of its corresponding chamber 500*a*, 500*b*, respectively, and thus can be fluidly connected to the corresponding chamber 500*a*, 500*b*, respectively.

In still yet other embodiments, some chambers may have a pressure adjusting device located upstream of the chamber; while other chambers may have a pressure adjusting device located downstream of the chamber; while yet other chambers may have a pressure adjusting device penetrating through the shell of its corresponding chamber.

In an embodiment, the pressure equalizing system 2000, for example as illustrated in FIG. 2, can comprise at least two second valves 550*a*, 550*b*; wherein each second valve 550*a*, 550*b* is located downstream of a corresponding chamber 500*a*, 500*b*, respectively; wherein each second valve 550*a*, 550*b* is configured to allow for a corresponding pressure adjusting device 300*a*, 300*b*, respectively, to adjust the pressure of its corresponding chamber 500*a*, 500*b*, respectively; for example as previously described herein for second valve 550, pressure adjusting device 300, and chamber 500.

In embodiments where the pressure equalizing system 2000 is in the pressure equalizing configuration for chamber 500*a*, the second valve 550*a* is actuated in a closed position, thereby fluidly isolating the chamber 500*a* from pressure equalizing system components other than the pressure adjusting device 300*a* (e.g., first pump 100, second pump 200) and allowing for the pressure adjusting device 300*a* to adjust the pressure of the chamber 500*a*. Similarly, when the pressure equalizing system 2000 is in the pressure equalizing configuration for chamber 500*b*, the second valve 550*b* is actuated in a closed position, thereby fluidly isolating the chamber 500*b* from pressure equalizing system components other than the pressure adjusting device 300*b* (e.g., first pump 100, second pump 200) and allowing for the pressure adjusting device 300*b* to adjust the pressure of the chamber 500*b*.

In embodiments where the pressure equalizing system 2000 is in the loading configuration for chamber 500*a*, the first valve 400*a* is configured to allow for the second stream having the second pressure 201*h* to enter and fill the chamber 500*a* with the second fluid (e.g., unclean fluid having the second pressure). In such embodiments, the second valve 550*a* may be actuated in a closed position, thereby allowing for the second fluid to enter and fill the chamber 500*a*, as opposed to flowing straight through chamber 500*a* and into streams 501*a*, 551*a*, and via tee 555 into stream 551.

Similarly, in embodiments where the pressure equalizing system 2000 is in the loading configuration for chamber 500*b*, the first valve 400*b* is configured to allow for the second stream having the second pressure 201*h* to enter and fill the chamber 500*b* with the second fluid (e.g., unclean fluid having the second pressure). In such embodiments, the second valve 550*b* may be actuated in a closed position, thereby allowing for the second fluid to enter and fill the chamber 500*b*, as opposed to flowing straight through chamber 500*b* and into streams 501*b*, 551*b*, and via tee 555 into stream 551.

In some embodiments where the pressure equalizing system is in the loading configuration, the second fluid interface separators 550*a*, 550*b* separate the relatively high pressure streams 551*a*, 551*b*, respectively, from the relatively low pressure streams 552*a*, 552*b*, respectively; i.e., the second fluid interface separators 550*a*, 550*b* allow for the flow of relatively low pressure clean fluid displaced from chambers 500*a*, 500*b*, respectively via conduits 501*a*, 501*b*, respectively, into streams 552*a*, 552*b*, respectively, while preventing the flow of fluid from chambers 500*a*, 500*b*, respectively into the relatively high pressure streams 551*a*, 551*b*, respectively.

In embodiments where the pressure equalizing system 2000 is in the discharging configuration for chamber 500*a*, the first valve 400*a* is configured to allow for a portion 103*a* of the high pressure first stream to enter chamber 500*a* and displace the second fluid, thereby providing for a stream 501*a*, 551*a* comprising the second fluid exiting the chamber 500*a* at about the first pressure. In such embodiments, the second valve 550*a* is actuated in an open position, thereby allowing for the second fluid (e.g., unclean fluid) having the first pressure to flow via tee 555 into stream 551.

Similarly, in embodiments where the pressure equalizing system 2000 is in the discharging configuration for chamber 500*b*, the first valve 400*b* is configured to allow for a portion 103*b* of the high pressure first stream to enter chamber 500*b* and displace the second fluid, thereby providing for a stream 501*b*, 551*b* comprising the second fluid exiting the chamber 500*b* at about the first pressure. In such embodiments, the second valve 550*b* is actuated in an open position, thereby allowing for the second fluid (e.g., unclean fluid) having the first pressure to flow via tee 555 into stream 551.

In some embodiments where the pressure equalizing system is in the discharging configuration, the second fluid interface separators 550*a*, 550*b* separate the relatively high pressure streams 551*a*, 551*b*, respectively from the relatively low pressure streams 552*a*, 552*b*, respectively; i.e., the second fluid interface separators 550*a*, 550*b* allow for the flow of relatively high pressure unclean fluid displaced from chambers 500*a*, 500*b*, respectively via conduits 501*a*, 501*b*, respectively into streams 551*a*, 551*b*, respectively, while preventing the flow of fluid from chambers 500*a*, 500*b*, respectively into the relatively low pressure streams 552*a*, 552*b*, respectively.

In embodiments where chambers 500*a*, 500*b* comprise the first fluid (e.g., clean fluid); during the loading configuration for each particular chamber 500*a*, 500*b*, the second fluid displaces the first fluid in the corresponding chamber 500*a*, 500*b*, thereby providing for streams 552*a*, 552*b*, respectively, comprising the first fluid exiting the chamber 500*a*, 500*b*, respectively, at about the second pressure. In such embodiments, the second valve 550*a*, 550*b* is actuated in an open position, thereby allowing for the first fluid (e.g., clean fluid) having the second pressure to flow into streams 552*a*, 552*b*, respectively. The second valve 550*a*, 550*b* can selectively allow for (i) the flow of unclean fluid from corresponding chamber 500*a*, 500*b*, respectively, into stream 551 (via streams 551*a*, 551*b*, respectively, and tee 555) during the discharging configuration for each corresponding chamber 500*a*, 500*b*, respectively; (ii) the flow of clean fluid from corresponding chamber 500*a*, 500*b*, respectively, into stream 552*a*, 552*b*, respectively, during the loading configuration for each corresponding chamber 500*a*, 500*b*, respectively; or (iii) no fluid flow from the corresponding chamber 500*a*, 500*b*, respectively, during the pressure equalizing configuration for each corresponding chamber 500*a*, 500*b*, respectively. The streams 552*a*, 552*b* comprising clean fluid can be introduced to the agent tank 210 comprising the second fluid; wherein the clean fluid from streams 552*a*, 552*b* can be mixed with the agent in the agent tank 210 for forming an unclean fluid slurry (e.g., second fluid).

In some embodiments where the pressure equalizing system is transitioning between the discharging configuration and the loading configuration for each particular chamber 500*a*, 500*b*, the pressure equalizing configuration comprises the second fluid interface separators 500*a*, 500*b*, respectively, configured to separate from each other each of (1) the pressure adjusting devices 300*a*, 300*b*, respectively and chambers 500*a*, 500*b*, respectively; (2) streams 551*a*, 551*b*, respectively, tee 560, stream 561; and (3) streams 552*a*, 552*b*, respectively. The pressure equalizing configuration for each particular chamber 500*a*, 500*b* can advantageously provide for pressure equalization across the second fluid interface separators 550*a*, 550*b*, respectively, thereby minimizing vibration, noise, erosion, etc. when the second fluid interface separators 550*a*, 550*b*, respectively are cycled (e.g., actuated in an open and/or closed position between various pressure equalizing system configurations).

In some embodiments where the pressure equalizing system comprises at least two chambers 500*a*, 500*b*; at least two chambers 500*a*, 500*b* can employ the same agent.

In other embodiments where the pressure equalizing system comprises at least two chambers 500*a*, 500*b*; at least two chambers 500*a*, 500*b* can employ agents different from each other. In such embodiments, employing different agents in different chambers 500*a* 500*b* can advantageously allow for tailoring the identity and concentration of the agent in streams 551, 561.

In an embodiment, a pressure equalizing system may comprise a first pump (e.g., high pressure pump, relatively high pressure pump), a second pump (e.g., low pressure pump, relatively low pressure pump), a first pressure adjusting device, a second pressure adjusting device, a cylindrical rotor, a low pressure intake cap, and a high pressure intake cap; wherein the low pressure intake cap and the high pressure intake cap are configured to be substantially static; wherein the cylindrical rotor is configured to rotate with respect to its longitudinal axis; wherein the first pump is configured to output a first stream at the first pressure (e.g., high pressure, relatively high pressure), wherein the first stream comprises a first fluid, wherein the first fluid is substantially free of an agent (e.g., sand); wherein the second pump is configured to output a second stream at a second pressure (e.g., low pressure, relatively low pressure), wherein the second stream comprises a second fluid comprising the agent; wherein the first pressure is equal to or greater than about 200% of the second pressure; wherein the cylindrical rotor has a pair of spatially opposing end sides with at least two channels extending axially therethrough; wherein the pair of spatially opposing end sides comprises a low pressure intake side and a high pressure intake side; wherein each end side comprises a hollow side portion for each channel and a continuous solid side portion surrounding the hollow side portions; wherein the solid side portion of each end side is configured to act as a fluid interface separator; wherein each channel is configured to receive the first fluid at about the first pressure from the first pump via the high pressure intake side and the second fluid at about the second pressure from the second pump via the low pressure intake side, and allow for pressure energy transfer from the first fluid to the second fluid; wherein each channel is configured to deliver the first fluid at about the second pressure and the second fluid at about the first pressure subsequent to the pressure energy transfer from the first fluid to the second fluid; and wherein the pressure equalizing system is transitionable between a loading configuration and a discharging configuration via a pressure equalizing configuration for each individual channel. In such embodiment, the fluid interface separator is a solid surface (e.g., substantially flat solid surface) that prevents (1) the first fluid at the first pressure from entering a channel of the cylindrical rotor during the filling configuration for that particular channel; (2) the second fluid at the second pressure from entering a channel of the cylindrical rotor during the discharging configuration for that particular channel; (3) the first fluid and the second fluid from entering a channel of the cylindrical rotor during the pressure equalizing configuration for that particular channel.

The low pressure intake cap has an outer side and an inner side and at least three ports extending therethrough; wherein the ports of the low pressure intake cap comprise (a1) a low pressure port fluidly connected to the second pump and configured to receive the second fluid at about the second pressure from the second pump and allow the second fluid at about the second pressure to enter a channel of the cylindrical rotor during the filling configuration for that particular channel, (a2) a high pressure port configured to receive the second fluid at about the first pressure from a channel and deliver the second fluid at about the first pressure into a pressurized second fluid stream during the discharging configuration for that particular channel, and (a3) a first pressure adjusting device port fluidly connected to the first pressure adjusting device; wherein the first pressure adjusting device is configured to adjust the pressure of a channel comprising the second fluid from about the second pressure to a pressure within about ±100 psig of the first pressure during the pressure equalizing configuration for that particular channel.

The high pressure intake cap has an outer side and an inner side and at least three ports extending therethrough; wherein the ports of the high pressure intake cap comprise (b1) a high pressure port fluidly connected to the first pump and configured to receive the first fluid at about the first pressure from the first pump and allow the first fluid at about the first pressure to enter a channel of the cylindrical rotor during the discharging configuration for that particular channel, (b2) a low pressure port configured to receive the first fluid at about the second pressure from a channel and deliver the first fluid at about the second pressure into a depressurized first fluid stream during the filling configuration for that particular channel, and (b3) a second pressure adjusting device port fluidly connected to a second pressure adjusting device; wherein the second pressure adjusting device is configured to adjust the pressure of a channel comprising the first fluid from about the first pressure to a pressure within about ±100 psig of the second pressure during the pressure equalizing configuration for that particular channel.

The cylindrical rotor is fluidly connected to the low pressure intake cap, wherein the low pressure intake side of the cylindrical rotor faces the inner side of the low pressure intake cap. The cylindrical rotor is fluidly connected to the high pressure intake cap, wherein the high pressure intake side of the cylindrical rotor faces the inner side of the high pressure intake cap.

In an embodiment, the cylindrical rotor is configured to rotate such that during the loading configuration of a particular channel, the particular channel is fluidly connected and aligned with both the low pressure port of the low pressure intake cap and the low pressure port of the high pressure intake cap; thereby providing for a continuous fluid path between the low pressure port of the low pressure intake cap and the low pressure port of the high pressure intake cap via the particular channel.

In an embodiment, the cylindrical rotor is configured to rotate such that during the discharging configuration of a particular channel, the particular channel is fluidly connected and aligned with both the high pressure port of the low pressure intake cap and the high pressure port of the high pressure intake cap; thereby providing for a continuous fluid path between the high pressure port of the low pressure intake cap and the high pressure port of the high pressure intake cap.

The cylindrical rotor is configured to rotate such that each channel transitions between the loading configuration and the discharging configuration via the pressure equalizing configuration. When the cylindrical rotor rotates with respect to its longitudinal axis, the solid side portion of each end side (e.g., fluid interface separator) can prevent the flow of a particular fluid in and out of particular channels, thereby setting the configuration for each channel. In an embodiment, a size and/or geometry of the solid side portion of each end side (e.g., fluid interface separator) can be any suitable size and/or geometry effective to (e.g., large enough to) selectively cover (e.g., obturate) each port as necessary or desired during the rotation of the cylindrical rotor; in order to provide for channels transitioning as desired between the loading configuration and the discharging configuration via the pressure equalizing configuration.

In some embodiments, the cylindrical rotor can comprise equal to or greater than about 2 channels, alternatively equal to or greater than about 3 channels, alternatively equal to or greater than about 4 channels, alternatively equal to or greater than about 5 channels, alternatively equal to or greater than about 6 channels, alternatively from about 2 channels to about 10 channels, alternatively from about 3 channels to about 7 channels, or alternatively from about 3 channels to about 5 channels.

In an embodiment, the rotation of the cylindrical rotor can be timed such that at least one channel is undergoing the discharging configuration at any given time thereby providing for a continuous process of transferring pressure energy from the first fluid to the second fluid, thereby delivering continuously the second fluid at the first pressure (e.g., pressurized second fluid stream). The concentration of the agent in the second fluid at the second pressure is substantially the same as the concentration of the agent in the second fluid at the first pressure, for example into a pressurized second fluid stream. In such embodiment, the pressurized second fluid stream can be a WSF, wherein the WSF comprises a fracturing fluid, a gravel packing fluid, or an acidizing fluid.

In an embodiment, the low pressure port of the low pressure intake cap and the high pressure port of the high pressure intake cap are fluidly sealed from each other regardless of the spatial rotational position of the cylindrical rotor; wherein the high pressure port of the low pressure intake cap and the low pressure port of the high pressure intake cap are fluidly sealed from each other regardless of the spatial rotational position of the cylindrical rotor.

In an embodiment, a method of exchanging fluid pressure as disclosed herein can comprise (a) pumping a second stream at a second pressure 201*h* via a second pump 200 (e.g., low pressure pump, relatively low pressure pump), wherein the second stream 201*l*, 201*h* comprises a second fluid comprising an agent (e.g., proppant, sand); (b) actuating a first valve 400 to allow the second stream having the second pressure 201*h* to enter a chamber 500; (c) flowing the second stream at the second pressure 201*h* into the chamber 500, wherein the second stream having the second pressure 201*h* fills the chamber 500; (d) fluidly isolating the chamber 500 by actuating the first valve 400 to stop the flow of the second stream into the chamber 500 and by actuating a second valve 550 located downstream of the chamber 500 in a closed position to stop fluid flow out of the chamber 500; (e) pressurizing the chamber 500 via a pressure adjusting device 300 from the second pressure to a pressure within about ±100 psig of a first pressure, wherein the first pressure is equal to or greater than about 200% of the second pressure; (f) pumping a first stream at the first pressure 101*h* via a first pump 100 (e.g., high pressure pump, relatively high pressure pump), wherein the first stream 101*l*, 101*h* comprises a first fluid, and wherein the first fluid is substantially free of the agent; (g) fluidly unisolating the chamber 500 by actuating the first valve 400 to allow a first portion 103 of the first stream at the first pressure to enter chamber 500 and by actuating the second valve 550 in an open position to allow for fluid flowing out of the chamber 500; and (h) flowing the first stream at the first pressure 101*h* into the chamber 500, wherein the first stream at the first pressure 101*h* displaces the second fluid, thereby providing for a third stream 501, 551 comprising the second fluid exiting the chamber 500 at about the first pressure. The method of exchanging fluid pressure as disclosed herein can further comprise (i) fluidly isolating the chamber 500 by actuating the first valve 400 to stop the flow of the first stream into the chamber 500 and by actuating the second valve 550 in a closed position to stop the flow of the third stream exiting the chamber 500; and (ii) depressurizing the chamber 500 via the pressure adjusting device 300 from the first pressure to a pressure within about ±100 psig of the second pressure. In such embodiment, the third stream 551 may contact a second portion 104 of the high pressure first stream to form a pressurized loaded stream 561 comprising a third fluid comprising the agent (e.g., high pressure sand laden fracturing fluid), wherein a concentration of agent in the third fluid is lower than a concentration of agent in the second fluid. The pressurized loaded stream 561 can be further introduced to a wellbore and/or subterranean formation, wherein the pressurized loaded stream 561 is a WSF, and wherein the WSF comprises a fracturing fluid, a gravel packing fluid, or an acidizing fluid.

In an embodiment, a method of exchanging fluid pressure can comprise (a) providing a high pressure first fluid 101*h* characterized by a first pressure and a low pressure second fluid 201*h* characterized by a second pressure; wherein the first pressure is equal to or greater than about 200% of the second pressure; wherein the first fluid 101*h* is an aqueous fluid substantially free of a proppant (e.g., sand); and wherein the second fluid 201*h* comprises the aqueous fluid and the proppant (e.g., sand); (b) transferring pressure energy from a first portion of the high pressure first fluid 101*h* to a first portion of the low pressure second fluid 201*h* to form a high pressure second fluid 551; (c) contacting the high pressure second fluid 551 with a second portion of the high pressure first fluid 101*h* to form a pressurized loaded stream 561 comprising a third fluid comprising the agent (e.g., high pressure sand laden fracturing fluid), wherein the third fluid comprises the aqueous fluid and the proppant (e.g., sand), and wherein a concentration of proppant in the third fluid is lower than a concentration of proppant in the second fluid; (d) depressurizing, subsequent to transferring pressure energy to the first portion of the low pressure second fluid 201*h*, the first portion of the high pressure first fluid 101*h* from the first pressure to a pressure within about ±100 psig of the second pressure; and (e) displacing the first portion of the first fluid characterized by a pressure within about ±100 psig of the second pressure with a second portion of the low pressure second fluid 201*h*. The method of exchanging fluid pressure as disclosed herein can further comprise transferring pressure energy from a third portion of the high pressure first fluid 101*h* to the second portion of the low pressure second fluid 201*h* to form the high pressure second fluid 551. In such embodiment, the first portion of the low pressure second fluid 201*h* and/or the second portion of the low pressure second fluid 201*h* can be pressurized from the second pressure to a pressure within about ±100 psig of the first pressure prior to receiving pressure energy from the high pressure first fluid 101*h*. In such embodiment, the pressurized loaded fluid 561 can be placed in a wellbore and/or subterranean formation to consolidate and/or enhance conductivity of at least a portion of the wellbore and/or subterranean formation.

In an embodiment, a method of servicing a wellbore in a subterranean formation can comprise (a) pumping a second stream at a second pressure 201*h* via a low pressure pump 200 (e.g., relatively low pressure pump), wherein the second stream 201*l*, 201*h* comprises a second fluid comprising an aqueous fluid and a proppant (e.g., sand); (b) actuating a first valve 400 to allow the second stream at the second pressure 201*h* to enter a chamber 500; (c) flowing the second stream at the second pressure 201*h* into the chamber 500, wherein the second stream at the second pressure 201*h* fills the chamber 500; (d) fluidly isolating the chamber 500 by actuating the first valve 400 to stop the flow of the second stream into the chamber 500 and by actuating a second valve 550 located downstream of the chamber 500 in a closed position to stop fluid flow out of the chamber 500; (e) pressurizing the chamber 500 via a pressure adjusting device 300 from the second pressure to a pressure within about ±100 psig of a first pressure, wherein the first pressure is from about 1,000 psig to about 50,000 psig, and wherein the first pressure is equal to or greater than about 200% of the second pressure; (f) pumping a first stream at the first pressure 101*h* via a high pressure pump 100 (e.g., relatively high pressure pump), wherein the first stream 101*l*, 101*h* comprises a first fluid, and wherein the first fluid is the aqueous fluid substantially free of the proppant; (g) fluidly unisolating the chamber 500 by actuating the first valve 400 to allow a first portion 103 of the first stream at the first pressure to enter chamber 500 and by actuating the second valve 550 in an open position to allow for fluid flowing out of the chamber 500; (h) flowing the first stream at the first pressure 101*h* into the chamber 500, wherein the first stream at the first pressure 101*h* displaces the second fluid, thereby providing for a third stream 501, 551 comprising the second fluid exiting the chamber 500 at about the first pressure; (i) contacting the third stream 551 with a second portion 104 of the high pressure first stream to form a WSF 561 comprising a fracturing fluid, wherein the fracturing fluid comprises the aqueous fluid and the proppant, wherein a concentration of the proppant in the fracturing fluid is lower than a concentration of the proppant in the second fluid, and wherein the WSF 561 is characterized by about the first pressure; and (j) placing the WSF 561 in the wellbore and/or subterranean formation to consolidate and/or enhance conductivity of at least a portion of the wellbore and/or subterranean formation. The method of servicing a wellbore in a subterranean formation as disclosed herein can further comprise (1) fluidly isolating the chamber 500 by actuating the first valve 400 to stop the flow of the first stream into the chamber 500 and by actuating the second valve 550 in a closed position to stop the flow of the third stream exiting the chamber 500; and (2) depressurizing the chamber 500 via the pressure adjusting device 300 from the first pressure to a pressure within about ±100 psig of the second pressure, wherein the second pressure is from about 10 psig to about 500 psig. In such embodiment, the second fluid (e.g., fracturing fluid) can be a sand slurry having from about 0.1 lbs to about 27 lbs of sand per gallon of aqueous fluid. The fracturing fluid can be characterized by a concentration of proppant effective to consolidate and/or enhance conductivity of at least a portion of the wellbore and/or subterranean formation.

In an embodiment, a method of exchanging fluid pressure as disclosed herein can comprise servicing a wellbore in a subterranean formation. As disclosed herein, the high pressure second fluid 551 and/or the pressurized loaded stream 561 can be any suitable wellbore servicing fluid (WSF). As used herein, a "servicing fluid" or "treatment fluid" refers generally to any fluid that may be used in a subterranean application in conjunction with a desired function and/or for a desired purpose, including but not limited to fluids used to drill, complete, work over, fracture, repair, or in any way prepare a wellbore for the recovery of materials residing in a subterranean formation penetrated by the wellbore. Examples of wellbore servicing fluids include, but are not limited to fracturing fluids, gravel packing fluids, diverting fluids, completion fluids, washing fluids, sweeping fluids, acidizing fluids, cement slurries, drilling fluids or muds, spacer fluids, lost circulation fluids, and the like. The servicing fluid is for use in a wellbore that penetrates a subterranean formation. It is to be understood that "subterranean formation" encompasses both areas below exposed earth and areas below earth covered by water such as ocean or fresh water.

In an embodiment, the WSF includes the agent and a wellbore servicing (WS) base fluid. In some embodiments, the WS base fluid is an aqueous fluid. In other embodiments, the WS base fluid is an oil-based fluid. In yet other embodiments, the WS base fluid includes an emulsion or an invert emulsion. The WS base fluid has been described in detail previously herein as clean fluid (e.g., first fluid).

The high pressure second fluid 551 and the second portion 104 of the high pressure clean fluid can be combined at the well site above the ground to form the pressurized loaded stream 561; alternatively, the high pressure second fluid 551 and the second portion 104 of the high pressure clean fluid can be combined in situ inside the wellbore and/or subterranean formation (up to an including depths near wellbore perforations). In some embodiments, the WSF can be prepared off-site, followed by transporting to (and, if necessary, stored at) the on-site location. In an embodiment, additional surfactants (e.g., conventional surfactants, conventional emulsifiers, etc.) may be added to the WSF on-the-fly (e.g., in real-time or on-location) along with the other components/additives. The resulting WSF may be introduced or pumped downhole where the agent of the WSF may function as intended (e.g., consolidate and/or enhance the conductivity of at least a portion of the wellbore and/or subterranean formation; decrease the pH; etc.).

The concentrations of the components in the WSF, e.g., the agent, can be adjusted to their desired amounts before delivering the WSF composition into the wellbore. Those concentrations thus are not limited to the original design specification of the WSF composition and can be varied to account for changes in the downhole conditions of the wellbore that may occur before the composition is actually pumped into the wellbore.

In an embodiment, the wellbore service being performed is a fracturing operation, such as for example hydraulic fracturing and/or frac-packing, wherein a WSF is placed (e.g., pumped downhole) in the formation. In such embodiment, the WSF is a fracturing fluid. As will be understood by one of ordinary skill in the art, the particular composition of a fracturing fluid will be dependent on the type of formation that is to be fractured. Fracturing fluids, in addition to an agent and a WS base fluid, typically comprise a conventional surfactant, an acid, friction reducers, gelling agents, scale inhibitors, pH-adjusting agents, oxygen scavengers, iron-control agents, corrosion inhibitors, bactericides, and the like.

In an embodiment, the fracturing fluid comprises a particulate material comprising a proppant of the type previously described herein. When deposited in a fracture, the proppant may form a proppant pack, resulting in conductive channels (e.g., flow channel spaces) through which fluids may flow to the wellbore. The proppant functions to prevent the fractures from closing due to overburden pressures.

In an embodiment, the wellbore service being performed is a gravel packing operation, wherein a WSF comprising a particulate material (e.g., gravel) is placed (e.g., pumped downhole) in the formation. In such embodiment, the WSF is a gravel packing fluid. Gravel packing operations commonly involve placing a gravel pack screen in the wellbore neighboring a desired portion of the subterranean formation, and packing the surrounding annulus between the screen and the subterranean formation with particulate materials that are sized to prevent and inhibit the passage of formation solids through the gravel pack with produced fluids. In some instances, a screenless gravel packing operation may be performed.

During well stimulation treatments, such as fracturing treatments and/or gravel packing treatments, the WSF (e.g., the fracturing fluid and/or gravel packing fluid) can suspend a particulate material (e.g., proppant, gravel, etc.) and deposit the particulate material in a desired location, such as for example a fracture, inter alia, to maintain the integrity of such fracture once the hydraulic pressure is released. After the particulate material is placed in the fracture and pumping stops, the fracture closes, wherein the particulate material prevents the fractures from closing due to overburden pressures.

In an embodiment, a pressure equalizing system and methods of using same as disclosed herein can display advantages when compared with conventional systems for providing relatively high pressure fluids comprising an agent that is undesirable in relatively high pressure pumps. When high pressure pumps are used without sand, for example, the life of pumps can be advantageously increased (e.g., at least doubled). With the pressure equalizing systems disclosed herein, the high pressure pumps can deliver high pressure clean fluids, wherein the unclean fluids (e.g., proppants, sand, bauxites, etc.) are pumped at a relatively low pressure. Further, sand can be advantageously mixed at relatively high concentrations (e.g., 20 lbs/gal or higher; for example as high as 27 lbs/gal, which is known as "wet sand") in the second fluid.

In an embodiment, the pressure equalizing system can advantageously reduce noise, vibration and erosion, for example in valves (e.g., valves in energy recovery devices). Additional advantages of the pressure equalizing systems and methods of using same as disclosed herein may be apparent to one of skill in the art viewing this disclosure.

ADDITIONAL DISCLOSURE

Embodiment A

A pressure equalizing system comprising a first pump (100), a second pump (200), a pressure adjusting device (300), a fluid interface separator (400), and a chamber (500); wherein the pressure equalizing system is transitionable between a loading configuration and a discharging configuration via a pressure equalizing configuration; wherein the first pump (100) is configured to output a first stream at a first pressure (101*h*), wherein the first stream (101*l*, 101*h*) comprises a first fluid, wherein the first fluid is substantially free of an agent; wherein the second pump (200) is configured to output a second stream at a second pressure (201*h*), wherein the second stream (201*l*, 201*h*) comprises a second fluid comprising the agent; wherein the first pressure is equal to or greater than about 200% of the second pressure; wherein the fluid interface separator (400) is located downstream of the first pump (100) and the second pump (200), and upstream of the pressure adjusting device (300) and the chamber (500); wherein the fluid interface separator (400) is configured to transition the pressure equalizing system between the loading configuration and the discharging configuration; wherein, when the pressure equalizing system is in the loading configuration, the fluid interface separator (400) is configured to separate a high pressure loading side from a low pressure loading side in the pressure equalizing system; wherein the high pressure loading side is characterized by about the first pressure; wherein the low pressure loading side is characterized by about the second pressure; wherein, when the pressure equalizing system is in the discharging configuration, the fluid interface separator (400) is configured to separate a high pressure discharging side from a low pressure discharging side in the pressure equalizing system; wherein the high pressure discharging side is characterized by about the first pressure; wherein the low pressure discharging side is characterized by about the second pressure; wherein the high pressure loading side comprises the first pump (100), wherein the low pressure loading side comprises the second pump (200), the pressure adjusting device (300), and the chamber (500); wherein the high pressure discharging side comprises the first pump (100), the pressure adjusting device (300), and the chamber (500), wherein the low pressure discharging side comprises the second pump (200); wherein, when the pressure equalizing system is transitioning between the discharging configuration and the loading configuration, the pressure equalizing configuration comprises the fluid interface separator (400) configured to separate from each other each of (i) the first pump (100), (ii) the second pump (200), and (iii) the pressure adjusting device (300) and the chamber (500); wherein, when the pressure equalizing system is in the pressure equalizing configuration and transitioning from the discharging configuration to the loading configuration, the pressure adjusting device (300) is configured to decrease the pressure of the chamber (500) from about the first pressure to a pressure within about ±100 psig of the second pressure; and wherein, when the pressure equalizing system is in the pressure equalizing configuration and transitioning from the loading configuration to the discharging configuration, the pressure adjusting device (300) is configured to increase the pressure of the chamber (500) from about the second pressure to a pressure within about ±100 psig of the first pressure.

Embodiment B

The pressure equalizing system of Embodiment A, wherein the pressure adjusting device (300) comprises a hydraulic cylinder, a piston, a plunger, a bellows, a bladder, or combinations thereof.

Embodiment C

The pressure equalizing system of any of Embodiments A and B, wherein the agent is selected from the group consisting of a proppant, sand, rocks, sticks, fibers, gravel, sintered bauxite, a ceramic material, a diverting material, an abrasive material, a fluid loss material, an acid, HCl, HF, a scale inhibitor, a friction reducer, an electronic device, a sensor, a sensor node, a wireless sensor node, a mote, and combinations thereof.

Embodiment D

The pressure equalizing system of any of Embodiments A through C, wherein the second fluid is a sand slurry having from about 0.1 lbs to about 27 lbs of sand per gallon of fluid.

Embodiment E

The pressure equalizing system of any of Embodiments A through D, wherein the first pressure is from about 1,000 psig to about 50,000 psig; and wherein the second pressure is from about 10 psig to about 500 psig.

Embodiment F

The pressure equalizing system of any of Embodiments A through E, wherein the pressure adjusting device (300) is located upstream of the chamber (500).

Embodiment G

The pressure equalizing system of any of Embodiments A through F, wherein the pressure adjusting device (300) is located downstream of the chamber (500).

Embodiment H

The pressure equalizing system of any of Embodiments A through G, wherein the chamber (500) comprises a shell, wherein the pressure adjusting device (300) penetrates through the shell of the chamber (500) and is fluidly connected to the chamber (500).

Embodiment I

The pressure equalizing system of any of Embodiments A through H, wherein the fluid interface separator (400) is a first valve (400).

Embodiment J

The pressure equalizing system of Embodiment I, wherein the first valve (400) comprises a 3-way valve or two 2-way valves.

Embodiment K

The pressure equalizing system of any of Embodiments I and J further comprising a second valve (550) located downstream of the chamber (500).

Embodiment L

The pressure equalizing system of Embodiment K, wherein, when the pressure equalizing system is in the pressure equalizing configuration, the first valve (400) is actuated in a closed position and the second valve (550) is actuated in a closed position, thereby fluidly isolating the chamber (500) from pressure equalizing system components other than the pressure adjusting device (300) and allowing for the pressure adjusting device (300) to adjust the pressure of the chamber (500).

Embodiment M

The pressure equalizing system of any of Embodiments A through L, wherein, during the loading configuration, the first valve (400) is configured to allow for the second stream having the second pressure (201*h*) to enter and fill the chamber (500) with the second fluid, while displacing first fluid from the chamber (500), thereby providing for a fourth stream (501, 552) comprising the first fluid exiting the chamber (500) at about the second pressure.

Embodiment N

The pressure equalizing system of Embodiment M, wherein, during the discharging configuration, the first valve (400) is configured to allow for a first portion (103) of the high pressure first stream to enter chamber (500) and displace the second fluid, thereby providing for a third stream (501, 551) comprising the second fluid exiting the chamber (500) at about the first pressure.

Embodiment O

The pressure equalizing system of Embodiment N, wherein the third stream (551) contacts a second portion (104) of the high pressure first stream to form a pressurized loaded stream (561) comprising a third fluid comprising the agent, wherein a concentration of agent in the third fluid is lower than a concentration of agent in the second fluid.

Embodiment P

The pressure equalizing system of Embodiment O, wherein the pressurized loaded stream (561) is a wellbore servicing fluid (WSF), wherein the WSF comprises a fracturing fluid, a gravel packing fluid, or an acidizing fluid.

Embodiment Q

The pressure equalizing system of any of Embodiments A through L, wherein the chamber (500) comprises the first fluid; and wherein, during the loading configuration, the second fluid displaces the first fluid in the chamber (500), thereby providing for a fourth stream (501, 552) comprising the first fluid exiting the chamber (500) at about the second pressure.

Embodiment R

The pressure equalizing system of Embodiment Q, wherein the fourth stream (552) is introduced to an agent tank (210) comprising the second fluid and wherein the agent tank (210) provides the second fluid for the second stream (201*l*, 201*h*).

Embodiment S

The pressure equalizing system of Embodiment R further comprising a reservoir (110) comprising the first fluid, wherein the reservoir (110) provides the first fluid for the first stream (1211, 121*h*); wherein the reservoir (110) optionally provides for a fifth stream (111) comprising the first fluid, and wherein the fifth stream (111) is introduced to the agent tank (210) to form the second fluid.

Embodiment T

The pressure equalizing system of Embodiment S further comprising a concentrated agent tank (220), wherein the concentrated agent tank (220) provides for a concentrated agent stream (221), wherein a concentration of the agent in the concentrated agent stream (221) is greater than the concentration of agent in the second fluid, wherein the concentrated agent stream (221) is introduced to the agent tank (210) to form the second fluid.

Embodiment U

The pressure equalizing system of any of Embodiments A through T comprising at least two chambers (500/500*a*, 500*b*) configured to operate in parallel; wherein at least one chamber (500/500*a*,500*b*) is in the discharging configuration at any given time, thereby providing for a continuous operation of the pressure equalizing system; wherein the pressure equalizing system comprises a pressure adjusting device (300/300*a*,300*b*) for each chamber (500/500*a*,500*b*); and wherein each pressure adjusting device (300/300*a*,300*b*) is configured to adjust the pressure in its corresponding chamber (500/500*a*,500*b*) during the pressure equalizing configuration of its corresponding chamber (500/500*a*, 500*b*).

Embodiment V

The pressure equalizing system of Embodiment U comprising at least two fluid interface separators (400/400*a*, 400*b*); wherein each fluid interface separator (400/400*a*, 400*b*) is located upstream of a corresponding chamber (500/500*a*,500*b*) and pressure adjusting device (300/300*a*, 300*b*), and downstream of the first pump (100) and the second pump (200).

Embodiment W

The pressure equalizing system of Embodiment V further comprising at least two second valves (550/550*a*,550*b*);

wherein each second valve (550/550*a*,550*b*) is located downstream of a corresponding chamber (500/500*a*,500*b*); wherein each second valve (550/550*a*,550*b*) is configured to allow for a corresponding pressure adjusting device (300/300*a*,300*b*) to adjust the pressure of its corresponding chamber (500/500*a*,500*b*).

Embodiment X

The pressure equalizing system of any of Embodiments U through W, wherein at least two chambers (500/500*a*,500*b*) employ agents different from each other.

Embodiment Y

The pressure equalizing system of any of Embodiments U through W, wherein at least two chambers (500/500*a*,500*b*) employ the same agent.

Embodiment Z

A pressure equalizing system comprising a first pump, a second pump, a first pressure adjusting device, a second pressure adjusting device, a cylindrical rotor, a low pressure intake cap, and a high pressure intake cap; wherein the low pressure intake cap and the high pressure intake cap are configured to be substantially static; wherein the cylindrical rotor is configured to rotate with respect to its longitudinal axis; wherein the first pump is configured to output a first stream at a first pressure, wherein the first stream comprises a first fluid, wherein the first fluid is substantially free of an agent; wherein the second pump is configured to output a second stream at a second pressure, wherein the second stream comprises a second fluid comprising the agent; wherein the first pressure is equal to or greater than about 200% of the second pressure; wherein the cylindrical rotor has a pair of spatially opposing end sides with at least two channels extending axially therethrough; wherein the pair of spatially opposing end sides comprises a low pressure intake side and a high pressure intake side; wherein each end side comprises a hollow side portion for each channel and a continuous solid side portion surrounding the hollow side portions; wherein the solid side portion each end side is configured to act as a fluid interface separator; wherein each channel is configured to receive the first fluid at about the first pressure from the first pump via the high pressure intake side and the second fluid at about the second pressure from the second pump via the low pressure intake side, and allow for pressure energy transfer from the first fluid to the second fluid; wherein each channel is configured to deliver the first fluid at about the second pressure and the second fluid at about the first pressure subsequent to the pressure energy transfer from the first fluid to the second fluid; wherein the pressure equalizing system is transitionable between a loading configuration and a discharging configuration via a pressure equalizing configuration for each individual channel; wherein the low pressure intake cap has an outer side and an inner side and at least three ports extending therethrough; wherein the ports of the low pressure intake cap comprise (a1) a low pressure port fluidly connected to the second pump and configured to receive the second fluid at about the second pressure from the second pump and allow the second fluid at about the second pressure to enter a channel of the cylindrical rotor during the filling configuration for that particular channel, (a2) a high pressure port configured to receive the second fluid at about the first pressure from a channel and deliver the second fluid at about the first pressure into a pressurized second fluid stream during the discharging configuration for that particular channel, and (a3) a first pressure adjusting device port fluidly connected to the first pressure adjusting device; wherein the first pressure adjusting device is configured to adjust the pressure of a channel comprising the second fluid from about the second pressure to a pressure within about ±100 psig of the first pressure during the pressure equalizing configuration for that particular channel; wherein the high pressure intake cap has an outer side and an inner side and at least three ports extending therethrough; wherein the ports of the high pressure intake cap comprise (b1) a high pressure port fluidly connected to the first pump and configured to receive the first fluid at about the first pressure from the first pump and allow the first fluid at about the first pressure to enter a channel of the cylindrical rotor during the discharging configuration for that particular channel, (b2) a low pressure port configured to receive the first fluid at about the second pressure from a channel and deliver the first fluid at about the second pressure into a depressurized first fluid stream during the filling configuration for that particular channel, and (b3) a second pressure adjusting device port fluidly connected to the second pressure adjusting device; wherein the second pressure adjusting device is configured to adjust the pressure of a channel comprising the first fluid from about the first pressure to a pressure within about ±100 psig of the second pressure during the pressure equalizing configuration for that particular channel; wherein the cylindrical rotor is fluidly connected to the low pressure intake cap, wherein the low pressure intake side of the cylindrical rotor faces the inner side of the low pressure intake cap; wherein the cylindrical rotor is fluidly connected to the high pressure intake cap, wherein the high pressure intake side of the cylindrical rotor faces the inner side of the high pressure intake cap; wherein the cylindrical rotor is configured to rotate such that during the loading configuration of a particular channel, the particular channel is fluidly connected and aligned with both the low pressure port of the low pressure intake cap and the low pressure port of the high pressure intake cap; wherein the cylindrical rotor is configured to rotate such that during the discharging configuration of a particular channel, the particular channel is fluidly connected and aligned with both the high pressure port of the low pressure intake cap and the high pressure port of the high pressure intake cap; and wherein the cylindrical rotor is configured to rotate such that each channel transitions between the loading configuration and the discharging configuration via the pressure equalizing configuration.

Embodiment AA

The pressure equalizing system of Embodiment Z, wherein the low pressure port of the low pressure intake cap and the high pressure port of the high pressure intake cap are fluidly sealed from each other regardless of the spatial rotational position of the cylindrical rotor; and wherein the high pressure port of the low pressure intake cap and the low pressure port of the high pressure intake cap are fluidly sealed from each other regardless of the spatial rotational position of the cylindrical rotor.

Embodiment AA

The pressure equalizing system of any of Embodiments Z and AA, wherein the pressurized second fluid stream is a wellbore servicing fluid (WSF), wherein the WSF comprises a fracturing fluid, a gravel packing fluid, or an acidizing fluid.

Embodiment CC

A method of exchanging fluid pressure comprising (a) pumping a second stream at a second pressure (201*h*) via a second pump (200), wherein the second stream (201*l*, 201*h*) comprises a second fluid comprising an agent; (b) actuating a fluid interface separator (400) to allow the second stream at the second pressure (201*h*) to enter a chamber (500); (c) flowing the second stream at the second pressure (201*h*) into the chamber (500), wherein the second stream at the second pressure (201*h*) fills the chamber (500); (d) fluidly isolating the chamber (500) by actuating the fluid interface separator (400) to stop the flow of the second stream into the chamber (500) and by actuating a second valve (550) located downstream of the chamber (500) in a closed position to stop fluid flow out of the chamber (500); (e) pressurizing the chamber (500) via a pressure adjusting device (300) from the second pressure to a pressure within about +100 psig of a first pressure, wherein the first pressure is equal to or greater than about 200% of the second pressure; (f) pumping a first stream at the first pressure (101*h*) via a first pump (100), wherein the first stream (101*l*, 101*h*) comprises a first fluid, and wherein the first fluid is substantially free of the agent; (g) fluidly unisolating the chamber (500) by actuating the fluid interface separator (400) to allow a first portion (103) of the first stream at the first pressure to enter chamber (500) and by actuating the second valve (550) in an open position to allow for fluid flowing out of the chamber (500); and (h) flowing the first stream at the first pressure (101*h*) into the chamber (500), wherein the first stream at the first pressure (101*h*) displaces the second fluid, thereby providing for a third stream (501, 551) comprising the second fluid exiting the chamber (500) at about the first pressure.

Embodiment DD

The method of Embodiment CC further comprising (i) fluidly isolating the chamber (500) by actuating the fluid interface separator (400) to stop the flow of the first stream into the chamber (500) and by actuating the second valve (550) in a closed position to stop the flow of the third stream exiting the chamber (500); and (ii) depressurizing the chamber (500) via the pressure adjusting device (300) from the first pressure to a pressure within about +100 psig of the second pressure.

Embodiment EE

The method of Embodiment DD, wherein the third stream (551) contacts a second portion (104) of the high pressure first stream to form a pressurized loaded stream (561) comprising a third fluid comprising the agent, wherein a concentration of agent in the third fluid is lower than a concentration of agent in the second fluid.

Embodiment FF

The method of any of Embodiments CC through EE further comprising introducing the pressurized loaded stream (561) in a wellbore and/or subterranean formation, wherein the pressurized loaded stream (561) is a wellbore servicing fluid (WSF), and wherein the WSF comprises a fracturing fluid, a gravel packing fluid, or an acidizing fluid.

Embodiment GG

A method of servicing a wellbore in a subterranean formation comprising (a) pumping a second stream at a second pressure (201*h*) via a low pressure pump (200), wherein the second stream (201*l*, 201*h*) comprises a second fluid comprising an aqueous fluid and a proppant; (b) actuating a first valve (400) to allow the second stream at the second pressure (201*h*) to enter a chamber (500); (c) flowing the second stream at the second pressure (201*h*) into the chamber (500), wherein the second stream at the second pressure (201*h*) fills the chamber (500); (d) fluidly isolating the chamber (500) by actuating the first valve (400) to stop the flow of the second stream into the chamber (500) and by actuating a second valve (550) located downstream of the chamber (500) in a closed position to stop fluid flow out of the chamber (500); (e) pressurizing the chamber (500) via a pressure adjusting device (300) from the second pressure to a pressure within about ±100 psig of a first pressure, wherein the first pressure is from about 1,000 psig to about 50,000 psig, and wherein the first pressure is equal to or greater than about 200% of the second pressure; (f) pumping a first stream at the first pressure (101*h*) via a high pressure pump (100), wherein the first stream (101*l*, 101*h*) comprises a first fluid, and wherein the first fluid is the aqueous fluid substantially free of the proppant; (g) fluidly unisolating the chamber (500) by actuating the first valve (400) to allow a first portion (103) of the first stream at the first pressure to enter chamber (500) and by actuating the second valve (550) in an open position to allow for fluid flowing out of the chamber (500); (h) flowing the first stream at the first pressure (101*h*) into the chamber (500), wherein the first stream at the first pressure (101*h*) displaces the second fluid, thereby providing for a third stream (501, 551) comprising the second fluid exiting the chamber (500) at about the first pressure; (i) contacting the third stream (551) with a second portion (104) of the high pressure first stream to form a wellbore servicing fluid (WSF) (561) comprising a fracturing fluid, wherein the fracturing fluid comprises the aqueous fluid and the proppant, wherein a concentration of the proppant in the fracturing fluid is lower than a concentration of the proppant in the second fluid, and wherein the WSF (561) is characterized by about the first pressure; and (j) placing the WSF (561) in the wellbore and/or subterranean formation to consolidate and/or enhance conductivity of at least a portion of the wellbore and/or subterranean formation.

Embodiment HH

The method of Embodiment GG further comprising (1) fluidly isolating the chamber (500) by actuating the first valve (400) to stop the flow of the first stream into the chamber (500) and by actuating the second valve (550) in a closed position to stop the flow of the third stream exiting the chamber (500); and (2) depressurizing the chamber (500) via the pressure adjusting device (300) from the first pressure to a pressure within about ±100 psig of the second pressure, wherein the second pressure is from about 10 psig to about 500 psig.

Embodiment II

The method of any of Embodiments GG and HH, wherein the second fluid is a sand slurry having from about 0.1 lbs to about 27 lbs of sand per gallon of aqueous fluid.

Embodiment JJ

The method of any of Embodiments GG through II, wherein the fracturing fluid is characterized by a concentration of proppant effective to consolidate and/or enhance conductivity of at least a portion of the wellbore and/or subterranean formation.

Embodiment KK

A method of exchanging fluid pressure comprising (a) providing a high pressure first fluid (101*h*) characterized by a first pressure and a low pressure second fluid (201*h*) characterized by a second pressure; wherein the first pressure is equal to or greater than about 200% of the second pressure; wherein the first fluid (101*h*) is an aqueous fluid substantially free of a proppant; and wherein the second fluid (201*h*) comprises the aqueous fluid and the proppant; (b) transferring pressure energy from a first portion of the high pressure first fluid (101*h*) to a first portion of the low pressure second fluid (201*h*) to form a high pressure second fluid (551); (c) contacting the high pressure second fluid (551) with a second portion of the high pressure first fluid (101*h*) to form a pressurized loaded stream (561) comprising a third fluid comprising the agent, wherein the third fluid comprises the aqueous fluid and the proppant, and wherein a concentration of proppant in the third fluid is lower than a concentration of proppant in the second fluid; (d) depressurizing, subsequent to transferring pressure energy to the first portion of the low pressure second fluid (201*h*), the first portion of the high pressure first fluid (101*h*) from the first pressure to a pressure within about ±100 psig of the second pressure; and (e) displacing the first portion of the first fluid characterized by a pressure within about ±100 psig of the second pressure with a second portion of the low pressure second fluid (201*h*).

Embodiment LL

The method of Embodiment KK further comprising transferring pressure energy from a third portion of the high pressure first fluid (101*h*) to the second portion of the low pressure second fluid (201*h*) to form the high pressure second fluid (551).

Embodiment MM

The method of Embodiment LL comprising pressurizing the first portion of the low pressure second fluid (201*h*) and/or the second portion of the low pressure second fluid (201*h*) from the second pressure to a pressure within about ±100 psig of the first pressure prior to receiving pressure energy from the high pressure first fluid (101*h*).

Embodiment NN

The method of any of Embodiments KK through MM further comprising placing the pressurized loaded fluid (561) in a wellbore and/or subterranean formation to consolidate and/or enhance conductivity of at least a portion of the wellbore and/or subterranean formation.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. When a feature is described as "optional," both embodiments with this feature and embodiments without this feature are disclosed. Similarly, the present disclosure contemplates embodiments where this feature is required and embodiments where this feature is specifically excluded. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference in the Description of Related Art is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A pressure equalizing system comprising a first pump, a second pump, a pressure adjusting device, a fluid interface separator, and a chamber; wherein the pressure equalizing system is transitionable between a loading configuration and a discharging configuration via a pressure equalizing configuration;

wherein the first pump is configured to output a first stream at a first pressure, wherein the first stream comprises a first fluid, wherein the first fluid is substantially free of an agent;

wherein the second pump is configured to output a second stream at a second pressure, wherein the second stream comprises a second fluid comprising the agent; wherein the first pressure is equal to or greater than about 200% of the second pressure;

wherein the fluid interface separator is located downstream of the first pump and the second pump, and upstream of the pressure adjusting device and the chamber; wherein the fluid interface separator is configured to transition the pressure equalizing system between the loading configuration and the discharging configuration;

wherein, when the pressure equalizing system is in the loading configuration, the fluid interface separator is configured to separate a high pressure loading side from a low pressure loading side in the pressure equalizing system; wherein the high pressure loading side is characterized by about the first pressure; wherein the low pressure loading side is characterized by about the second pressure;

wherein, when the pressure equalizing system is in the discharging configuration, the fluid interface separator is configured to separate a high pressure discharging side from a low pressure discharging side in the pressure equalizing system; wherein the high pressure discharging side is characterized by about the first pressure; wherein the low pressure discharging side is characterized by about the second pressure;

wherein the high pressure loading side comprises the first pump, wherein the low pressure loading side comprises the second pump, the pressure adjusting device, and the chamber; wherein the high pressure discharging side comprises the first pump, the pressure adjusting device, and the chamber, wherein the low pressure discharging side comprises the second pump;

wherein, when the pressure equalizing system is transitioning between the discharging configuration and the loading configuration, the pressure equalizing configuration comprises the fluid interface separator configured to separate from each other each of (i) the first pump, (ii) the second pump, and (iii) the pressure adjusting device and the chamber;

wherein, when the pressure equalizing system is in the pressure equalizing configuration and transitioning from the discharging configuration to the loading configuration, the pressure adjusting device is configured to decrease the pressure of the chamber from about the first pressure to a pressure within about ±100 psig of the second pressure; and wherein, when the pressure equalizing system is in the pressure equalizing configuration and transitioning from the loading configuration to the discharging configuration, the pressure adjusting device is configured to increase the pressure of the chamber from about the second pressure to a pressure within about ±100 psig of the first pressure.

2. The pressure equalizing system of claim 1, wherein the pressure adjusting device comprises a hydraulic cylinder, a piston, a plunger, a bellows, a bladder, or combinations thereof.

3. The pressure equalizing system of claim 1, wherein the agent is selected from the group consisting of a proppant, sand, rocks, sticks, fibers, gravel, sintered bauxite, a ceramic material, a diverting material, an abrasive material, a fluid loss material, an acid, HCl, HF, a scale inhibitor, a friction reducer, an electronic device, a sensor, a sensor node, a wireless sensor node, a mote, and combinations thereof.

4. The pressure equalizing system of claim 1, wherein the pressure adjusting device is located upstream of the chamber and/or downstream of the chamber.

5. The pressure equalizing system of claim 1, wherein the chamber comprises a shell, wherein the pressure adjusting device penetrates through the shell of the chamber and is fluidly connected to the chamber.

6. The pressure equalizing system of claim 1, wherein the fluid interface separator is a first valve; wherein the first valve comprises a 3-way valve or two 2-way valves; and wherein the pressure equalizing system further comprises a second valve located downstream of the chamber.

7. The pressure equalizing system of claim 6, wherein, when the pressure equalizing system is in the pressure equalizing configuration, the first valve is actuated in a closed position and the second valve is actuated in a closed position, thereby fluidly isolating the chamber from pressure equalizing system components other than the pressure adjusting device and allowing for the pressure adjusting device to adjust the pressure of the chamber.

8. The pressure equalizing system of claim 1, wherein, during the loading configuration, the first valve is configured to allow for the second stream having the second pressure to enter and fill the chamber with the second fluid, while displacing the first fluid from the chamber, thereby providing for a fourth stream comprising the first fluid exiting the chamber at about the second pressure.

9. The pressure equalizing system of claim 8, wherein, during the discharging configuration, the first valve is configured to allow for a first portion of the high pressure first stream to enter the chamber and displace the second fluid, thereby providing for a third stream comprising the second fluid exiting the chamber at about the first pressure.

10. The pressure equalizing system of claim 9, wherein the third stream contacts a second portion of the high pressure first stream to form a pressurized loaded stream comprising a third fluid comprising the agent, wherein a concentration of the agent in the third fluid is lower than a concentration of the agent in the second fluid.

11. The pressure equalizing system of claim 10, wherein the pressurized loaded stream is a wellbore servicing fluid (WSF), wherein the WSF comprises a fracturing fluid, a gravel packing fluid, or an acidizing fluid.

12. The pressure equalizing system of claim 1 comprising at least two chambers configured to operate in parallel; wherein at least one chamber is in the discharging configuration at any given time, thereby providing for a continuous operation of the pressure equalizing system; wherein the pressure equalizing system comprises a pressure adjusting device for each chamber; and wherein each pressure adjusting device is configured to adjust the pressure in a corresponding chamber during the pressure equalizing configuration of the corresponding chamber.

13. The pressure equalizing system of claim 12 comprising at least two fluid interface separators; wherein each fluid interface separator is located upstream of a corresponding chamber and pressure adjusting device, and downstream of the first pump and the second pump.

14. The pressure equalizing system of claim 13 further comprising at least two second valves; wherein each second valve is located downstream of a corresponding chamber; wherein each second valve is configured to allow for a corresponding pressure adjusting device to adjust the pressure of the corresponding chamber.

15. A pressure equalizing system comprising a first pump, a second pump, a first pressure adjusting device, a second pressure adjusting device, a cylindrical rotor, a low pressure intake cap, and a high pressure intake cap; wherein the low pressure intake cap and the high pressure intake cap are configured to be substantially static; wherein the cylindrical rotor is configured to rotate with respect to a longitudinal axis of the cylindrical rotor;

wherein the first pump is configured to output a first stream at a first pressure, wherein the first stream comprises a first fluid, wherein the first fluid is substantially free of an agent;

wherein the second pump is configured to output a second stream at a second pressure, wherein the second stream comprises a second fluid comprising the agent; wherein the first pressure is equal to or greater than about 200% of the second pressure;

wherein the cylindrical rotor has a pair of spatially opposing end sides with at least two channels extending axially therethrough; wherein the pair of spatially opposing end sides comprises a low pressure intake side and a high pressure intake side; wherein each end side comprises a hollow side portion for each channel and a continuous solid side portion surrounding the hollow side portions; wherein the solid side portion of each end side is configured to act as a fluid interface separator;

wherein each channel is configured to receive the first fluid at about the first pressure from the first pump via the high pressure intake side and the second fluid at about the second pressure from the second pump via the low pressure intake side, and allow for pressure energy transfer from the first fluid to the second fluid; wherein each channel is configured to deliver the first fluid at about the second pressure and the second fluid at about the first pressure subsequent to the pressure energy transfer from the first fluid to the second fluid;

wherein the pressure equalizing system is transitionable between a loading configuration and a discharging configuration via a pressure equalizing configuration for each individual channel;

wherein the low pressure intake cap has an outer side and an inner side and at least three ports extending therethrough; wherein the ports of the low pressure intake cap comprise (a1) a low pressure port fluidly connected to the second pump and configured to receive the second fluid at about the second pressure from the second pump and allow the second fluid at about the second pressure to enter a channel of the cylindrical rotor during the filling configuration for that particular channel, (a2) a high pressure port configured to receive the second fluid at about the first pressure from a channel and deliver the second fluid at about the first pressure into a pressurized second fluid stream during the discharging configuration for that particular channel, and (a3) a first pressure adjusting device port fluidly connected to the first pressure adjusting device; wherein the first pressure adjusting device is configured to adjust the pressure of a channel comprising the second fluid from about the second pressure to a pressure within about ±100 psig of the first pressure during the pressure equalizing configuration for that particular channel;

wherein the high pressure intake cap has an outer side and an inner side and at least three ports extending therethrough; wherein the ports of the high pressure intake cap comprise (b1) a high pressure port fluidly connected to the first pump and configured to receive the first fluid at about the first pressure from the first pump and allow the first fluid at about the first pressure to enter a channel of the cylindrical rotor during the discharging configuration for that particular channel, (b2) a low pressure port configured to receive the first fluid at about the second pressure from a channel and deliver the first fluid at about the second pressure into a depressurized first fluid stream during the filling configuration for that particular channel, and (b3) a second pressure adjusting device port fluidly connected to the second pressure adjusting device; wherein the second pressure adjusting device is configured to adjust the pressure of a channel comprising the first fluid from about the first pressure to a pressure within about ±100 psig of the second pressure during the pressure equalizing configuration for that particular channel;

wherein the cylindrical rotor is fluidly connected to the low pressure intake cap, wherein the low pressure intake side of the cylindrical rotor faces the inner side of the low pressure intake cap; wherein the cylindrical rotor is fluidly connected to the high pressure intake cap, wherein the high pressure intake side of the cylindrical rotor faces the inner side of the high pressure intake cap;

wherein the cylindrical rotor is configured to rotate such that during the loading configuration of a particular channel, the particular channel is fluidly connected and aligned with both the low pressure port of the low pressure intake cap and the low pressure port of the high pressure intake cap;

wherein the cylindrical rotor is configured to rotate such that during the discharging configuration of a particular channel, the particular channel is fluidly connected and aligned with both the high pressure port of the low pressure intake cap and the high pressure port of the high pressure intake cap; and wherein the cylindrical rotor is configured to rotate such that each channel transitions between the loading configuration and the discharging configuration via the pressure equalizing configuration.

16. The pressure equalizing system of claim 15, wherein the low pressure port of the low pressure intake cap and the high pressure port of the high pressure intake cap are fluidly sealed from each other regardless of the spatial rotational position of the cylindrical rotor; and wherein the high pressure port of the low pressure intake cap and the low pressure port of the high pressure intake cap are fluidly sealed from each other regardless of the spatial rotational position of the cylindrical rotor.

17. A method of exchanging fluid pressure comprising:

(a) providing a high pressure first fluid characterized by a first pressure and a low pressure second fluid characterized by a second pressure; wherein the first pressure is equal to or greater than about 200% of the second pressure; wherein the first fluid is an aqueous fluid substantially free of a proppant; and wherein the second fluid comprises the aqueous fluid and the proppant;

(b) transferring pressure energy from a first portion of the high pressure first fluid to a first portion of the low pressure second fluid to form a high pressure second fluid;

(c) contacting the high pressure second fluid with a second portion of the high pressure first fluid to form a pressurized loaded stream comprising a third fluid comprising the proppant, wherein the third fluid comprises the aqueous fluid and the proppant, and wherein a concentration of the proppant in the third fluid is lower than a concentration of the proppant in the second fluid;

(d) depressurizing, subsequent to transferring pressure energy to the first portion of the low pressure second fluid, the first portion of the high pressure first fluid from the first pressure to a pressure within about ±100 psig of the second pressure; and (e) displacing the first portion of the first fluid characterized by a pressure within about ±100 psig of the second pressure with a second portion of the low pressure second fluid.

18. The method of claim 17 further comprising transferring pressure energy from a third portion of the high pressure first fluid to the second portion of the low pressure second fluid to form the high pressure second fluid.

19. The method of claim 18 comprising pressurizing the first portion of the low pressure second fluid and/or the second portion of the low pressure second fluid from the second pressure to a pressure within about ±100 psig of the first pressure prior to receiving pressure energy from the high pressure first fluid.

20. The method of claim 17 further comprising placing the pressurized loaded stream in a wellbore and/or subterranean formation to consolidate and/or enhance conductivity of at least a portion of the wellbore and/or subterranean formation.

* * * * *